US012234618B2

(12) United States Patent
Evans et al.

(10) Patent No.: US 12,234,618 B2
(45) Date of Patent: Feb. 25, 2025

(54) GROUND STABILISATION

(71) Applicant: SHORE DEFENCE LIMITED, Kingsbridge (GB)

(72) Inventors: Marcus Paul Evans, Kingsbridge (GB); William Paul Evans, Kingsbridge (GB)

(73) Assignee: SHORE DEFENCE LIMITED, Kingsbridge (GB)

( * ) Notice: Subject to any disclaimer, the term of this patent is extended or adjusted under 35 U.S.C. 154(b) by 0 days.

(21) Appl. No.: 18/289,883

(22) PCT Filed: May 4, 2022

(86) PCT No.: PCT/GB2022/051136
§ 371 (c)(1),
(2) Date: Nov. 7, 2023

(87) PCT Pub. No.: WO2022/234275
PCT Pub. Date: Nov. 10, 2022

(65) Prior Publication Data

US 2024/0271380 A1 Aug. 15, 2024

(30) Foreign Application Priority Data

May 7, 2021 (WO) ..... PCT/GB2021/051111
Jul. 12, 2021 (GB) ..... 2110009.4

(51) Int. Cl.
*E02B 3/12* (2006.01)
*E02D 17/20* (2006.01)
*E02D 29/02* (2006.01)

(52) U.S. Cl.
CPC ..... *E02B 3/124* (2013.01); *E02B 3/123* (2013.01); *E02D 29/0208* (2013.01)

(58) Field of Classification Search
CPC ..... E02B 3/123; E02B 3/124; E02D 29/0208
See application file for complete search history.

(56) References Cited

U.S. PATENT DOCUMENTS 4,394,924 A * 7/1983 Zaccheroni ..... B21F 27/14 405/32
5,076,735 A 12/1991 Hilfiker
(Continued)

FOREIGN PATENT DOCUMENTS

CN 213086712 U 4/2021
EP 1308562 A1 5/2003
(Continued)

*Primary Examiner* — Frederick L Lagman
*Assistant Examiner* — Stacy N Lawson
(74) *Attorney, Agent, or Firm* — Thomas| Horstemeyer, LLP

(57) ABSTRACT

A ground stabilisation system, a cell assembly and a kit of parts for such a system, and methods of making and installing such cell assemblies are disclosed. A cell assembly (1701) comprises a rock containment cell having a bottom, first and second sides, first and second ends and a top each formed from chain-link wire mesh, wherein a first continuous sheet of mesh (1710) wraps around and defines the upper, lower and end faces of the cell assembly and is joined end to end by an overlapping join. The first side face is defined by a continuous length of chain-link wire mesh that at least partially wraps around another adjacent face of the cell assembly, and the second side face of the cell assembly is defined by a continuous length of chain-link wire mesh that at least partially wraps around another adjacent face of the cell assembly. The mesh defining the first and second side faces may be a single continuous sheet (1720).

20 Claims, 12 Drawing Sheets

(56) References Cited

U.S. PATENT DOCUMENTS

| | | | | |
|---|---|---|---|---|
| 8,721,221 | B2 | 5/2014 | Cavenagh | |
| 8,721,229 | B2 | 5/2014 | Heselden | |
| 9,260,830 | B2 | 2/2016 | Schneider | |
| 9,758,939 | B2 | 9/2017 | Adams | |
| 10,731,309 | B2 | 8/2020 | Adams | |
| 11,180,897 | B2 | 11/2021 | Waid | |
| 2006/0275084 | A1 | 12/2006 | Harbeck | |
| 2009/0202308 | A1* | 8/2009 | Heselden | E02D 29/0208 405/273 |
| 2009/0230373 | A1 | 9/2009 | Helseden | |
| 2010/0111611 | A1 | 5/2010 | Olsta | |
| 2010/0172701 | A1* | 7/2010 | Tucker | F41H 11/08 405/284 |
| 2012/0230766 | A1 | 9/2012 | Schnaars, Sr. | |
| 2013/0094905 | A1 | 4/2013 | Schnaars, Sr. | |
| 2015/0023733 | A1 | 1/2015 | Schnaars, Sr. | |
| 2015/0041599 | A1* | 2/2015 | Wartmann | B21F 27/02 245/8 |
| 2015/0071708 | A1* | 3/2015 | Ferraiolo | E02B 3/108 140/6 |
| 2016/0168837 | A1 | 6/2016 | Pettey | |
| 2018/0214929 | A1* | 8/2018 | Wendeler-Goeggelmann | B21F 27/04 |
| 2019/0075738 | A1 | 3/2019 | Manning | |
| 2021/0029895 | A1 | 2/2021 | Han | |

FOREIGN PATENT DOCUMENTS

| | | | |
|---|---|---|---|
| EP | 1881114 | A2 | 1/2008 |
| GB | 845863 | A | 8/1960 |
| JP | H07189229 | A | 7/1995 |
| JP | H09 256343 | A | 9/1997 |
| JP | H11 93132 | A | 4/1999 |
| JP | 2001 107366 | A | 4/2001 |
| JP | 3654852 | B2 | 6/2005 |
| JP | 2008-180069 | A | 8/2008 |
| JP | 2012255308 | A * | 12/2012 |
| JP | 2016-020577 | A | 2/2016 |
| JP | 2016-084608 | A | 5/2016 |
| KR | 10-2004-0038036 | A | 5/2004 |
| KR | 10-0666908 | B1 | 1/2007 |
| KR | 100 755 754 | B1 | 9/2007 |
| KR | 10-2009-0086795 | A | 9/2009 |
| KR | 10-0950248 | B1 | 3/2010 |
| KR | 2010009035 | U * | 9/2010 |
| KR | 10-1244710 | B1 | 3/2013 |
| KR | 10-1897064 | B1 | 9/2018 |

* cited by examiner

Fig. 3a
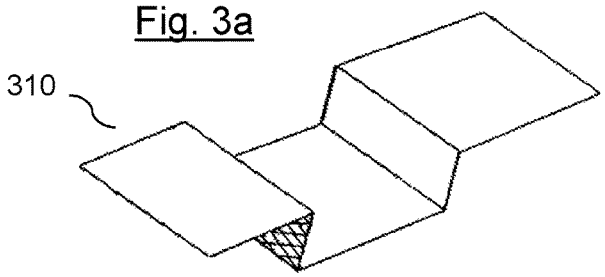
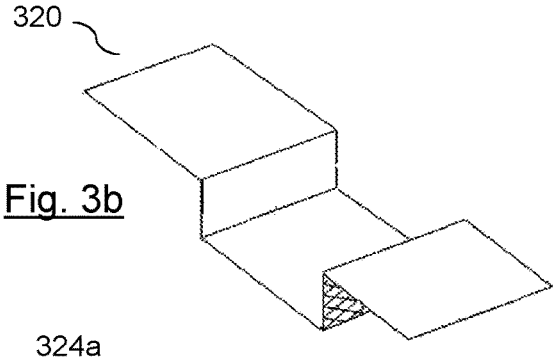
Fig. 3b
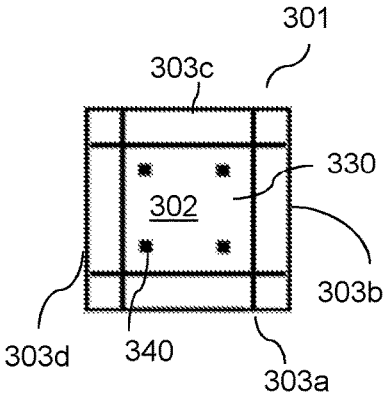
Fig. 3d
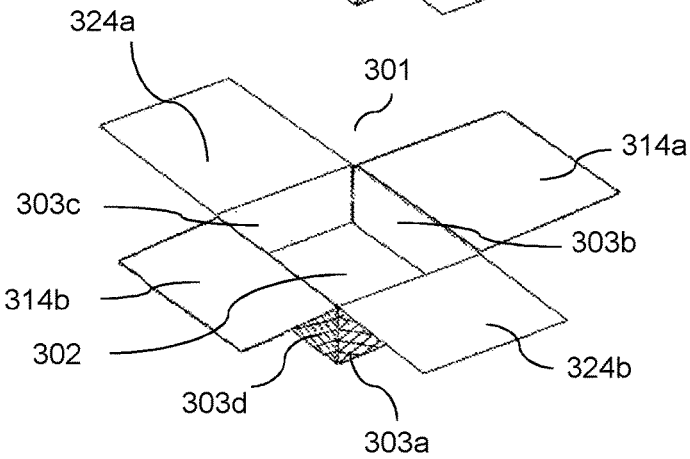
Fig. 3c
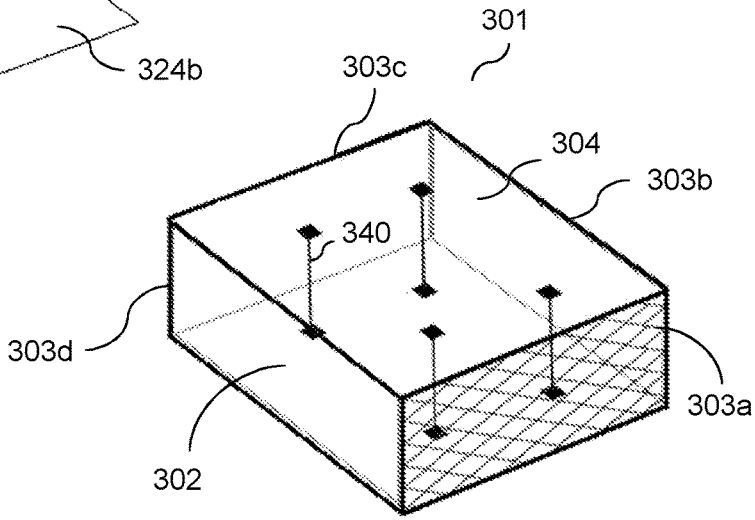
Fig. 3e Fig. 4a
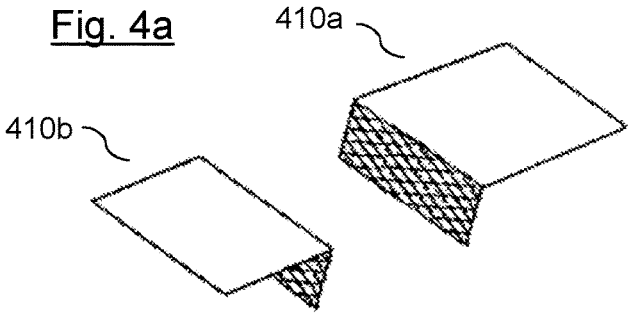
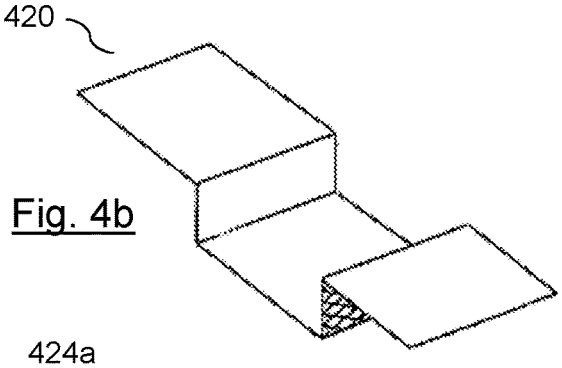
Fig. 4b
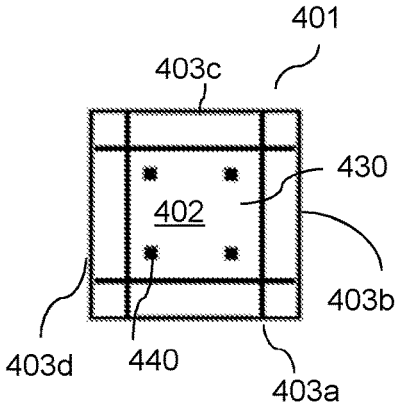
Fig. 4d
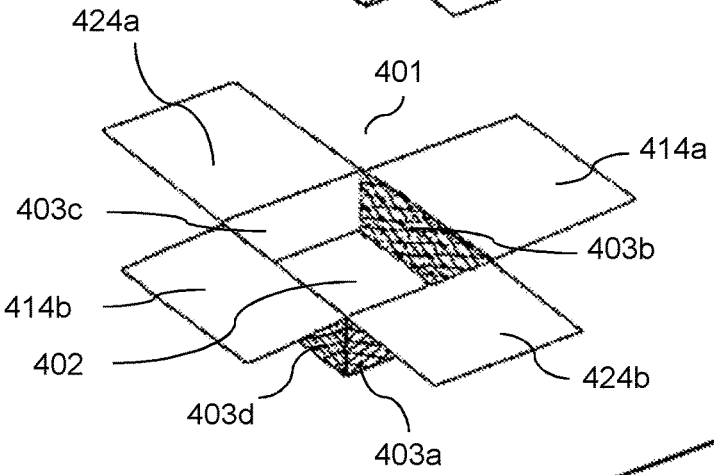
Fig. 4c
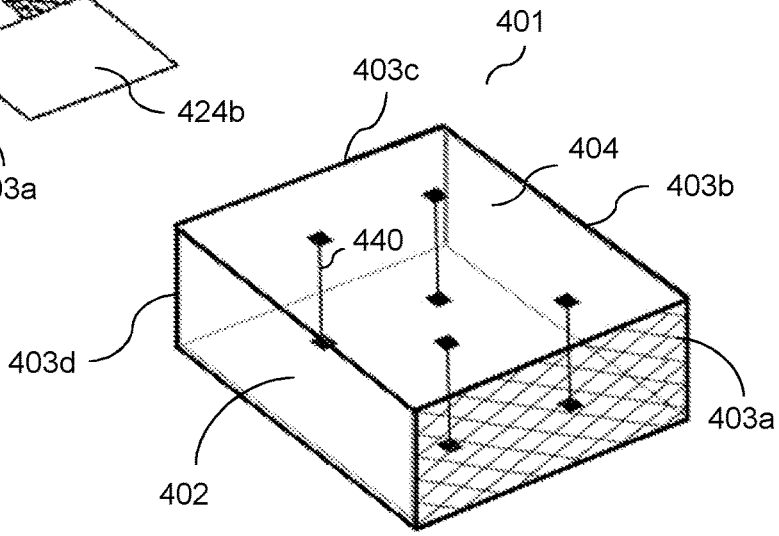
Fig. 4e

GROUND STABILISATION

CROSS-REFERENCE TO RELATED APPLICATIONS

This Application is the 35 U.S.C. § 371 national stage application of PCT Application No. PCT/GB2022/051136, filed May 4, 2022, where the PCT claims priority to, and the benefit of, United Kingdom application no. 2110009.4, filed Jul. 12, 2021, and PCT Application No. PCT/GB2021/051111, filed May 7, 2021, all of which are herein incorporated by reference in their entireties.

FIELD OF THE INVENTION

The present invention concerns a ground stabilisation/protection assembly, and methods of constructing and installing such an assembly. Optionally, the assembly provides an erosion prevention system, e.g. for use in preventing ground erosion by water, such as coastal erosion, for example erosion of beaches and sand dunes, sea-floor erosion, such as around manmade installations e.g. foundations, and inland erosion, for example erosion of riverbanks and lake shorelines. Additionally or alternatively, the assembly may be used to stabilise, protect and/or support groundworks, such as foundations, embankments, cuttings and such-like.

BACKGROUND OF THE INVENTION

Groundworks are subjected to various man-made and natural disturbances, which can lead to damage and/or premature failure. For example, coastal erosion results in the loss or displacement of earth, rock or sediment from the coastline due to the action of waves, tidal currents and storms on the shoreline. Coastal storms are particularly damaging to coastlines due to the generation of powerful waves which are capable of undermining banks, washing away sections of beaches and displacing large rocks and boulders up to several tonnes in weight. Coastal erosion devastates coastal communities because of loss of land and property into the sea, and has a significant economic impact. Coastal erosion can also cause damage to the local ecosystem, for example through ingress of brackish water into bodies of fresh water. Without implementation of mitigating measures, coastal erosion is expected to increase as climate change intensifies the severity and frequency of storms. In a similar manner, river floodwater can cause erosion of riverbanks, weakening the bank and increasing the likelihood of repeated flooding in the future. Riverbank erosion can occur in a number of ways. Firstly, excessive river levels and water flow velocity can erode the sides of riverbanks even when there is no flooding of the surrounding area. Additionally, when there has been flooding of surrounding areas, floodwater returning to the river can damage the riverbank as it recedes. Softer material along the top of or behind the river bank, and which is normally protected from erosion when the river is at its normal level, is particularly vulnerable. Repeated episodes of flooding can cause a vicious cycle of erosion lowering riverbank levels in localised areas, naturally favouring flow of floodwater across the damaged section. Furthermore, the slow erosion of softer material behind the riverbank will undermine the bank over time, eventually causing sections to collapse, and allowing the river to breach the bank. Erosion prevention may also be required in underwater locations, for example to protect the foundations of man-made structures such as bridge/harbour/ wind turbine footings. Such protection may be useful where currents (natural currents or e.g. caused by shipping) may disturb a riverbed, lake bed or sea floor. Other types of groundworks also often require some degree of support and/or protection. In particular, foundations (for buildings, roads, railways etc.), embankments and cuttings may utilise some form of structural support, for example using boulders, concrete and/or gabions. Even if not typically subjected to wave action, such installations must still withstand external forces arising from loading by man-made structures/vehicles and/or ground movement.

A frequently used form of ground protection (especially as erosion prevention) is rock armour, typically comprising large boulders that are often not aesthetically attractive and do not blend into the environment. Also, individual boulders, even boulders weighing many tonnes, can be moved by external forces, such as wave action and/or ground movement. Boulders dislocation leaves gaps and creates weak spots. Maintenance of rock armour is costly and time consuming. When used in coastal erosion control, rock armour is also undesirable because it exposes solid rock faces to incoming waves, leading to large amounts of deflected spray that may cause other damage. Concrete structures can also be used, and often suffers from similar disadvantages, as well as being prohibitively costly to install over a large area and vulnerable to natural degradation over time.

Rock gabions have been used in some settings for ground stabilisation (including erosion control). Gabions are wire mesh baskets filled with smaller rocks. A gabion may have a size of 2 m by 1 m by 1 m (i.e. 2 $m^3$), giving a mass (when filled with rock) of around 3 tonnes. FIG. 1*a* shows a conventional gabion 101 of those dimensions, subdivided by an internal partition 102 to form two 1 $m^3$ cells 103*a*, 103*b*. Each cell has a base 104, four sides 105 (only one side is labelled in FIG. 1*a*) and a lid 106. The lid 106 and base 104 extends across both cells 103*a*, 103*b*. While the smaller rock sizes in gabions can help with dissipation of wave energy, the relatively low mass of individual gabions makes them susceptible to being moved by waves. Gabions can be made of a more elongate design (e.g. with a length and width considerably larger than their height), and/or attached in series to form a protective structure or "mattress" which is used to stabilise banks or cliffs from coastal erosion. FIG. 1*b* shows an alternative, conventional gabion design 110 with a larger lateral cross-sectional area. However, the joins between individual gabions are points of weakness vulnerable to fracture under the impact of waves. Loads on the joins between gabions are amplified by the relatively rigid and inflexible structure of each individual gabion. If not adequately maintained, failure of these joins can result in the mattress being pulled apart by the action of the sea. While such gabion structures can be relatively straightforward to install because they remove the need for transport of large rocks, installation tends to be very time-consuming as each gabion must be assembled and joined to its neighbours, for example by welding or fastening adjacent structures. Gabion mattresses may be formed from woven steel wire mesh. Gabions and gabion mattresses are typically manufactured from wire mesh, the wire being mild steel coated with a zinc, zinc/aluminium alloy, and/or plastic (e.g. pvc), and having a diameter of 2.0-3.0 mm and a tensile strength of 350 to 550 $N/mm^2$. Gabions can offer a relatively low cost form of coastal protection, but can have a lifetime as low as 5-10 years when exposed to harsh marine environments. An example of a gabion mattress is the Reno Mattress® available from Maccaferri®. Degradation of gabions presents a number of problems. Firstly, replacing defences is costly, and failure of defences can result in severe damage to property. Maintenance also tends to be costly, and often requires invasive measures that are highly disruptive and damaging to site ecology. Finally, decomposition of gabion components can release pollutants that contaminate the natural environment.

Erosion defence products similar to those used in coastal defences have been employed for protection of riverbanks. However, while the forces to which riverbanks are exposed tend to be less violent than those experienced by coastal shorelines, the problems of scouring and undermining by excessive water flow persist. Furthermore, many riverbank sites are even less accessible than shoreline locations, and often more ecologically fragile. Consequently, maintenance is often infeasible. Products similar to those used in erosion control, especially gabions, could be considered for other types of ground stabilisation. While products installed on land may not be subjected to wave action or water currents, other forces can cause similar damage. Furthermore, construction and installation difficulties persist in all settings.

EP1308562A1 discloses a gabion made from double-twist wire mesh coated with PVC, the base of the gabion having a protruding skirt that overlaps neighbouring gabions. The lid of the gabion does not overlap with neighbouring gabions. KR100755754B, KR101244710B and KR100950248B1 disclose similar systems with overlapping base skirts. KR1020090086795A discloses a gabion made from panels of welded wire mesh and having an extended base protruding into a slope; U.S. Pat. No. 5,076,735A, KR1020040038036A, JP2016084608A and JPH07189229A disclose further gabion systems with base extensions extending into a slope and/or over the top of offset stacked cells. Gabions constructed from double twisted wire mesh are also disclosed in US2015/0071708A1 and KR100666908B1; US2008/0264546A1 discloses a gabion system for controlling contaminants in soil, sediment or water, the gabions being lined with reactive geotextile mats; GB845863A, KR101897064B1 and JP2008180069A disclose gabions formed from chain-link wire mesh, with each panel of mesh being bounded by a stiff frame wire; in those disclosures, cells are separate units with no overlapping lids or bases. JP2016020577A discloses a device for connecting adjacent gabions to each other. Problems encountered with such known gabion designs include premature structural failure of gabions themselves, and/or joins between gabions, and awkward and time-consuming construction on-site (often in challenging environments). Traditional gabion design requires that gabions can be fully assembled off-site, or folded up from a template on-site, and that gabions are free-standing to facilitate filling. Consequently, gabions are constructed from stiff/resilient mesh or utilise stiff framework wires, and panels are made to a pre-determined size. Mesh can be stiffened by welding intersections (introducing inherent weaknesses) or by entwined (e.g. double twist) mesh geometry (requiring relatively low-strength, malleable wires which are more vulnerable to failure). Filling pre-sized gabions requires care: overfilling can distort gabions making them hard to close and join, under-filling can lead to unwanted buckling/movement after installation. Furthermore, pre-sized gabions are difficult to install on uneven ground.

JP2012255308A discloses another gabion made from wire mesh. Two essential features of the gabion are the use of a double twist mesh, and the use of a synthetic resin monofilament as the wire. Paragraph [0002] explains the importance of the synthetic resin monofilament, while paragraphs [0026] and [0030] make it clear that the double twist mesh is used and arranged in a manner that ensures rigidity while the gabion is filled. With reference to FIGS. 7 and 9, a manufacturing method is described in which sheets of a predetermined size are prepared, and then the gabion assembled off-site, before collapsing and rolling the unfilled gabion for transport. Accordingly, the gabion of JP2012255308A suffers from the disadvantages of other known gabion designs, which rely on an inherent rigidity to aid filling and thus require careful and precise filling and installation on site. Similar gabion designs are disclosed in CN213086712U and EP188114 A2.

UK patent application nos. 2007166.8 and 2017230.0, filed on 14 May 2020 and 30 Oct. 202, respectively (Shore Defence Ltd.) describe erosion prevention systems comprising multiple rock-filled cells constructed from a wire mesh.

There remains a need to provide long-term, environmentally sensitive, low maintenance ground stabilisation and protection products. The present invention seeks to mitigate the above disadvantages and provide a ground stabilisation assembly, and methods of constructing and installing the assembly, which is durable, cost-effective and discrete. More particularly, the invention may provide improved ground protection systems, offering rapid, convenient and flexible installation, long-term resilience in challenging environments, and a discrete appearance sympathetic to natural surroundings.

SUMMARY OF THE INVENTION

According to a first aspect of the invention, there is provided a cell assembly having opposed upper and lower faces, opposed first and second end faces and opposed first and second side faces. Optionally, the cell assembly is a cell assembly according to the claims. The cell assembly comprises at least one cell for containment of rock pieces. Preferably, the at least one cell has a bottom, first and second upstanding sides, at least a first upstanding end, and a top. The faces of the cell assembly, and optionally the bottom, top, sides and end(s) of the cell, are formed from chain-link wire mesh (such as steel wire mesh, optionally stainless steel). A first continuous length of chain-link wire mesh defines the opposed upper and lower faces and the opposed end faces of the cell assembly. The first side face of the cell assembly is defined by a continuous length of chain-link wire mesh that at least partially wraps around one or two adjacent face(s) of the cell assembly. The second side face of the cell assembly is defined by a continuous length of chain-link wire mesh that at least partially wraps around one or two adjacent face(s) of the cell assembly. Optionally, the first and second side faces are both defined by a second continuous length of chain-link wire mesh that extends across a lower, end or upper face (preferably lower face) of the cell assembly, thereby overlapping the first continuous length on that face. Alternatively, the first side face is defined by a second continuous length of chain-link wire mesh, and the second side face is defined by a third continuous length of chain-link wire mesh separate from the second continuous length. It will be understood that a length of mesh 'defines' a face of a cell assembly when the length of mesh extends across the entire face. It will be appreciated that when a continuous length of chain-link wire mesh forms the lower, end and upper faces of the cell assembly, the length of mesh wraps around a circumference of the cell assembly, providing an especially strong and effective cell construction. It will be further appreciated that the woven chain-link structure of the wire mesh facilitates such a wrap-around structure without bending (and thus risking weakening) individual wires of the mesh. Optionally, the wire mesh lengths are fastened together at edges of the cell assembly faces by one or more tie wires and/or a plurality of clips. Rather than a rigid structure that bends, deforms and consequently weakens under stress, a chain-link wire mesh provides a flexible, self-tensioning structure that strengthens as it stretches across uneven and sometimes shifting ground. Overlapping joins between sheets of mesh allow cell sizes to be adjusted to suit the precise location for each cell, and the amount and nature of rock fill material available and suitable for the installation location.

It will be understood that each sheet of wire mesh may have two opposed ends (end edges) and two opposed sides (side edges), with the cut ends of the wires forming the chain-link wire mesh located at the side edges. It will be further understood that interlaced wires forming the chain-link mesh extend across the plane of each sheet from one side edge to the opposed side edge, in a general direction parallel to the opposed end edges. Optionally, the cut ends are knotted, for example knotted together to close the mesh openings running along each side edge of the mesh. Optionally, the cut end of each wire is knotted into a loop that interlocks with a corresponding loop on the cut end of an adjacent wire. An especially useful form of wire mesh is TECCO® wire mesh provided by GEOBRUGG®. When rolls of mesh are strung together by interlacing end wires to form a single continuous sheet of mesh, knotted loops on the interlaced end wires may be clipped together rather than interlocked, e.g. where equipment for interlocking wire ends is not available. It will be understood that such an arrangement does not alter the sheet geometry, since the end wires are fully interlaced along their length.

Preferably, the first continuous length of wire mesh has a first end and a second end, wherein the first end and the second end are fastened together at a join, e.g. located on upper, first end or second end face of the cell assembly, preferably at least partially on the upper face (e.g. on the upper face). Optionally the join is an overlapping join, wherein the first end overlaps the second end. Preferably, at least a portion (for example one or both ends) of the second and/or third continuous length overlaps a portion of the first continuous length of wire mesh, e.g. with the continuous lengths fastened together by an overlapping join positioned on adjacent face(s).

When the first and second side faces are defined by the second continuous length of chain-link wire mesh that extends across a bottom, end or top face, a double layer of mesh is formed on that face where the first and second lengths overlap. Such a double layer of mesh on one face has been found to increase strength, and added strength to the bottom may be especially useful if the cell requires lifting (e.g. when installation comprises filling and closing cells in one location, such as at an assembly site or on a floating vessel, and then lifting/lowering cells into a final location, such as an underwater location). Optionally, one or both ends of the second continuous length at least partially wrap around a further face between the first and second opposed faces, again overlapping the first continuous length, e.g. wherein opposed ends of the second continuous length are joined end to end. It will be appreciated that the end to end join may be any join as described in relation to the first continuous length, and/or the join may be located on any face (e.g. on one or more of the side, end and top faces, preferably the top face). Optionally, a first continuous chain-link wire mesh formed from at least one single sheet joined end to end at a first join defines the bottom, opposed ends and top faces of a cell assembly, and a second continuous chain-link wire mesh formed from at least one single sheet joined end to end at a second join defines the opposed sides of the cell assembly. Optionally the first and second join are each overlapping joins and/or are located on an opposed end and/or top face of the cell assembly, for example on the same face, such as the top face. Optionally, the second (and optionally third, if present) continuous length is positioned inside the first continuous length (the second/third continuous length forming an inner mesh layer), or is positioned outside (to form an outer mesh layer), or is positioned inside the first continuous length on one face and outside the first continuous length on another opposed face. It has been found that such an inside/outside wrap imparts particularly high cell strength. It will be understood that 'inner' and 'outer' are terms relative to the interior of the cell assembly.

Preferably, the wire mesh forming the cell assembly is a tensioned wire mesh. It will be understood that the wire mesh may be tensioned by, for example, stretching the mesh around the fill material when the cell assembly is constructed. It has been found that such tensioning can help stabilise the shape of the cell assembly, both during transportation/installation and during use, extending design life. It will be appreciated that a cell assembling comprising mesh so tensioned has a tendency to distort to the shape of the fill material, especially when the fill material includes large rock pieces. Optionally, the first continuous sheet of wire mesh is tensioned to at least 1 kN, such as at least 2 kN, for example at least 5 kN, along its length (the length running from end to end). It will be appreciated that the mesh may be so tensioned by drawing the mesh tightly around the fill material before forming the overlapping join connecting the opposed ends of the sheet. Preferably, the continuous chain-link wire mesh forming the first and second sides of the cell assembly is also tensioned to at least 1 kN, such as at least 2 kN, for example at least 5 kN, lengthways. It will be appreciated that said mesh may be so tensioned by drawing the mesh tightly around the fill material before fastening together opposing ends of the mesh (e.g. when the first and second sides are formed by a second continuous sheet of mesh that wraps around the cell assembly to join end to end) and/or fastening the mesh to the first continuous sheet of mesh. It will be appreciated that some fastenings between sheets of mesh may be made before insertion of fill material, and thus before tensioning (e.g. fastenings that join sides of sheets together at cell assembly edges). It will be appreciated that mesh tension may be increased further by installation of one or more brace assemblies (described herein below). Optionally, each chain-link wire mesh so tensioned (e.g. each chain-link wire mesh forming the faces of the cell assembly) has a tension of 1 kN to 150 kN, such as 2 kN to 75 kN, for example 5 kN to 25 kN, along at least a portion of its length. It will be appreciated that tension in the mesh may increase when cell assemblies are lifted (e.g. suspended), such as during transportation/installation. Tension values described above refer to tension in the wire mesh when the cell assembly is at rest (e.g. placed on the ground).

Optionally, a continuous length of wire mesh is formed from one or more single continuous sheets of chain-link wire mesh, wherein each single sheet extends along the whole of the continuous length from end to end. Optionally, each single continuous sheet has opposed first and second ends, wherein the ends joined together so that each sheet warps around at least a portion of the cell assembly spanning the upper and lower faces, and the first and second sides or ends. Optionally, a continuous length of wire mesh is formed from a single continuous sheet of wire mesh, for example with the opposing ends of the sheet joined end to end. Alternatively, a continuous length of wire mesh is formed from a plurality of single sheets, for example wherein the sheets making up a length are joined side to side, optionally wherein at least one side of each sheet overlaps and is fastened to a side of an adjacent sheet. It has been found that a single sheet extending along a length of mesh from end to end provides consistent mesh geometry from end to end (avoiding, e.g., excessive misalignment of the mesh pattern), simplifies installation and improves structural integrity. In a single continuous sheet of chain-link wire mesh, each wire in the body of the mesh (i.e. every wire apart from the wires at the opposing ends of the sheet) is interlaced with two neighbouring wires (one on each side). Typically, chain link wire mesh is provided as a pre-manufactured roll. If a roll of mesh has insufficient length to form the required continuous length of wire mesh, two or more rolls may be strung together by interlacing the end wires, thereby forming a single continuous sheet of wire mesh. End wires may be interlaced directly with each other (e.g. by unlacing/unweaving the end wire from at least one sheet (optionally both sheets) and then lacing/weaving the end wire(s) back into both sheets) or by inserting one or more (preferably two) strands of chain-link wire substantively identical to those of the rolls in terms of shape, material and dimensions. In such an arrangement, the connection between rolls is not discernible across the mesh once the wires are interlaced—there is no variation in the mesh pattern, nor in shape/dimension of wires forming the mesh. In contrast, separate sheets of mesh joined together end to end or side to side by, e.g., fastening loops or spirals (such as helicoil fasteners) would not be considered to be a single continuous sheet.

Alternatively, a continuous length of wire mesh is formed from a plurality of separate sheets of wire mesh, wherein each sheet is joined end to end (i.e. an end of one sheet is joined to the end of another sheet). It will be understood that separate sheets of wire mesh form a continuous length of wire mesh when the sheets have the same orientation, for example when the mesh sheets are joined with an end edge of a first mesh parallel to an end edge of a second mesh. First and second chain-link wire mesh sheets have the same orientation when the joined general direction in which the interlaced wires extend across the plane of the first sheet is parallel to the general direction in which interlaced wires extend across the plane of the second sheet.

Preferably, each sheet of the first continuous length wraps around the cell assembly and spans each of the upper, lower and first and second end faces of the cell assembly. Preferably, each sheet of the second continuous length spans the first side face and extends across at least a portion of said adjacent face. Preferably, each sheet of the third continuous length, if present, spans the second side face and extends across at least a portion of said adjacent face. Optionally, each sheet of the second continuous length spans the first and second side faces and another face (e.g. the lower face) of the cell assembly, and optionally extends across or spans a further face (e.g. the upper face). It will be understood that a sheet of mesh 'spans' a face of a cell assembly when the sheet extends from one edge of the face to an opposed edge of the face. Thus, the sheet extends entirely across the face in one direction (e.g. the entire width, or the entire length), but may or may not extend entirely across the face in all directions. Thus, a sheet may span a face while extending across only a portion of said face. For example, when a length of mesh defining a face consists of two or more sheets, each sheet may span said face.

Optionally, one or more, or all, end to end joins between sheet ends are located at an edge between cell assembly faces, optionally an edge positioned between the upper face and an end face. Additionally or alternatively, one or more, or all, end to end joins are located on a face of the cell assembly, such as spaced apart from an edge of the cell assembly. Locating a join on a face of the cell may allow more convenient closure of the cell during assembly. Optionally, one or more, or all, joins are located on the upper face of the cell assembly. Optionally, one or more, or each, end to end join is an overlapping join, for example with one sheet end overlapping another sheet end. An overlapping join may facilitate a stronger fastening between the sheets. Additionally or alternatively, an overlapping join may provide a more convenient fastening during cell assembly, for example providing better allowance for variations in cell dimensions during filling and/or allowing the sheet of mesh to be pulled taut, further improving the strength and resilience of the cell assembly. It will be appreciated that an overlapping join may be located entirely on a face of the cell assembly, or spanning an edge so that the overlapping join extends across at least a portion of two adjacent faces. Optionally, the overlap is at least 80 mm, such as at least 150 mm, for example at least 200 mm. It will be understood that the overlap is the distance across the overlap separating the end edges of the sheets. Optionally, the overlap is at least one row of mesh openings, such as at least two rows of mesh openings, for example at least three rows of mesh openings. It will be understood that the overlap is x rows of mesh openings when x rows of openings of one sheet end overlap x rows of openings of the other sheet end.

Optionally, the cell assembly has an approximately cuboid shape. Optionally, sides of the cell are opposed upstanding sides, and the cell comprises a second upstanding end opposing the first upstanding end. For example, the at least one cell has an approximately cuboid shape. It will be appreciated that the at least one cell may be any shape, for example having a triangular cross-section. Preferably, the bottom of the cell is aligned with and/or is formed by at least part of the lower face of the cell assembly. Additionally or alternatively, at least one end of the cell is aligned with and/or is formed by at least part of an end face of the cell assembly. Additionally or alternatively, at least one side of the cell is aligned with and/or is formed by at least part of a side face of the cell assembly.

Preferably (e.g. when the continuous lengths of mesh are each formed from one single continuous sheet), the cell assembly has a width of 1-5 m (e.g. 2-4 m), a length of 1-5 m (e.g. 2-4 m), and a height of 0.15-1.5 m (e.g. 0.4-0.8 m). It has been found that such sizes, especially a cell assembly having the exemplary sizes, provide a particularly useful balance between ease of manufacture/transport and stability once installed. Optionally (e.g. when one or more of the continuous lengths of mesh are formed from a plurality of single continuous sheets), the cell assembly has a width of 1-25 m (e.g. 2-20 m), a length of 1-25 m (e.g. 2-20 m), and a height of 0.15-2 m (e.g. 0.4-1 m). Larger sizes may be particularly useful when high mass structures are needed. Additionally or alternatively, the cell assembly has a total internal volume of at least 0.15 $m^3$, such as at least 0.4 $m^3$, for example at least 1.5 $m^3$, optionally at least 2.5 $m^3$. Additionally or alternatively (e.g. when the continuous lengths of mesh are each formed from one single continuous sheet), the cell assembly has a total internal volume of up to 40 $m^3$, such as up to 20 $m^3$, for example up to 10 $m^3$. Additionally or alternatively (e.g. when one or more of the continuous lengths of mesh are formed from a plurality of single continuous sheets), the cell assembly has a total internal volume of up to 1250 $m^3$, such as up to 800 $m^3$, for example up to 400 $m^3$. Once constructed, the cell assembly has an enclosed internal volume, for containment of rock pieces, with all faces defined by wire mesh.

Optionally, the cell assembly comprises a plurality of cells. Preferably, each cell has a bottom, first and second upstanding sides, at least a first upstanding end (e.g. first and second upstanding ends), and a top, wherein the bottoms, the sides, the ends and the tops are formed from chain-link wire mesh. Providing a plurality of cells can allow formation of a cell assembly of particular high mass, while also avoiding undue movement of material within the cell assembly. Optionally, at least one side of each cell is defined by a chain-link wire mesh side panel that defines a side of an adjacent cell. Additionally or alternatively, at least one end of each cell is defined by a chain-link wire mesh end panel that defines an end of an adjacent cell. Accordingly, it will be appreciated that the cell assembly may optionally comprise a plurality of cells arranged side-by-side, and/or end-on-end. Providing multiple cells may provide a multi-cell structure with intimately and resiliently linked cells. It will be understood that cells arranged end-to-end may optionally have sides defined by a side panel common to two or more cells (i.e. one side panel defining the sides of two adjacent cells). Similarly, cells arranged side-by-side may optionally have ends defined by an end panel common to two or more cells (i.e. one end panel defining the ends of two adjacent cells). Optionally, each of the plurality of cells has an approximately cuboid shape. Optionally, sides of each cell are opposed upstanding sides, and each cell comprises a second upstanding end opposing the first upstanding end. For example, each cell may have a cuboid shape. Preferably, the bottom of each cell is aligned with and/or is formed by at least part of the lower face of the cell assembly. Additionally or alternatively, at least one end of each cell is aligned with and/or is formed by at least part of an end face of the cell assembly. Additionally or alternatively, at least one side of each cell is aligned with and/or is formed by at least part of a side face of the cell assembly. It will be understood that the panels forming sides and/or ends of cells within a cell assembly may be referred to as baffles, subdividing the cell assembly. It will be appreciated that baffles may be used to subdivide the cell assembly into cells of any convenient shape and size, for example cells having a triangular, square or rectangular cross-section, and that cells in the same cell assembly may have different sizes and/or shapes. Preferably, each panel is formed from the same wire mesh material as used to form the sheets defining the faces of the cell assembly.

Preferably, each cell in a subdivided cell assembly has a length of 0.2-2 m (e.g. 0.5-1 m), a width of 0.2-2 m (e.g. 0.4-1 m), a height of 0.15-1.5 m (e.g. 0.4-0.8 m), and optionally an internal volume of 0.01-4 $m^3$ (e.g. 0.1-0.8 $m^3$). All faces of the cell may be defined by wire mesh so that the internal volume of the cell is entirely surrounded by the wire mesh. As used herein, a cell may have an undivided internal volume. For example, each cell may be free from a wire mesh panel subdividing the cell into a plurality of sub cells. It will be understood that a brace assembly positioned in a cell, if present, does not subdivide its internal volume. Optionally, the cell assembly is a single cell assembly comprising one cell. It will be appreciated that when the cell assembly is a single cell assembly, the continuous length of chain-link wire mesh defining the lower, end and upper faces of the cell assembly forms the bottom, ends and top of the cell.

The wire mesh sheets may be fastened together by any suitable connection system. Connection systems may be continuous (where multiple point connections are formed by a single device) or discontinuous (where point connections are each formed by a discrete device). A point connection is a single position at which a wire of one wire mesh is fixed to a wire of another wire mesh. Suitable continuous fastening devices include tie wires. Examples of suitable tie wires include flexible wire (e.g. woven in a zig-zag pattern through mesh openings of the fastened panels) and rigid wire (e.g. zig-zag or helicoil shaped rigid wire configured to stich the wire mesh of fastened sheets together). A continuous connection device may provide at least one point connection per mesh opening along the length of the device. Suitable discrete fastening devices include clips, such as wire clips. Example wire clips include c-clips that can be closed around wires of adjacent sheets, preferably where said wires lie against each other. Further example wire clips include pressed claw clips (such as the T1 pressed claw clip available from Geobrugg®) and spring clips (such as the T3 spring clip available from Geobrugg®).

Optionally, the sheets are fastened together at the cell edges by one or more tie wires and/or a plurality of clips. Optionally, sheets are fastened along a cell edge by a continuous fastening device that extends along more than 50%, such as at least 75%, for example at least 90%, of the length of the edge. Additionally or alternatively, sheets are fastened along a cell edge by a plurality of discrete fastening devices, optionally wherein the fastening devices are spaced along the edge so that the spacing between neighbouring fastening devices and between each end of the edge and the nearest fastening device is no more than 30%, such as no more than 25%, for example no more than 20%, of the length of the edge. Additionally or alternatively, discrete fastening devices are spaced apart by a distance equal to the length and/or width of the mesh openings. Fastening devices arranged to provide point connections distributed along most of a cell edge provide particularly strong joins. It will be appreciated that a combination of continuous and discrete fastening devices may be used on the same edge.

Optionally, overlapping sheets are fastened together by one or more tie wires and/or a plurality of clips. Optionally, such a continuous fastening device extends across more than 50%, such as at least 75%, for example 90%, of the width of the overlap area. Additionally or alternatively, overlapping sheets are fastened by a plurality of discrete fastening devices, optionally wherein the fastening devices are spaced across the width of the overlap area so that the spacing between neighbouring fastening devices and between opposed edges of overlap area and the nearest fastening device is no more than 30%, such as no more than 25%, for example no more than 20%, of the width of the overlap area. Fastening devices arranged to provide point connections distributed along most of the width of an overlap area provide particularly strong joins. Optionally, overlapping sheets by at least two such continuous fastening devices, or at least two rows of such discrete fastening devices, optionally wherein the at least two continuous fastening devices, or the at least two rows of such fastening devices are spaced apart across the length of the overlap area. Providing spaced apart, parallel arrays of point connections strengthens joins, not only because of the increased number of point connections, but also because the spaced apart arrays help to avoid one sheet twisting away from the other sheet along the one point connection array. It will be appreciated that a combination of continuous and discrete fastening devices may be used on the same overlap area.

Any suitable wire may be used to form the wire mesh sheets. Optionally, the wire is high tensile wire, such as high tensile steel wire. Wire used to form tie wires and/or clips for fastening panels together is optionally high tensile wire, such as high tensile steel wire. As used herein, high tensile steel wire has a tensile strength of at least 1,000 N/mm$^2$, optionally at least 1,500 N/mm$^2$, such as at least 1,650 N/mm$^2$, at least 2, 200 N/mm$^2$ or at least 2,700 N/mm$^2$. Optionally, the high tensile steel wire has a tensile strength of up to 3,200 N/mm$^2$. Optionally, high tensile wire has a diameter of at least 2 mm, such as at least 3 mm, for example at least 4 mm. Optionally, high tensile wire has a diameter of no more than 8 mm, such as no more than 6 mm, for example no more than 5 mm. Such wire provides an effective balance between strength and flexibility. Optionally, the wire mesh used to form panels has a tensile strength of at least 75 kN/m, such as at least 100 kN/m, for example at least 130 kN/m. Mesh tensile strength is measured as described in European Assessment Document 230025-00-0106. Preferably, the high tensile wire is corrosion resistant steel wire. Optionally, the high tensile wire is formed from stainless steel, such as austenitic, ferritic or duplex stainless steel, preferably duplex stainless steel. It will be understood that stainless steel is an iron-based alloy having a chromium content of at least about 11% by weight. Duplex stainless steel has a mixed microstructure of austenite and ferrite, providing improved yield strength as compared to austenitic stainless steel. Optionally, the high tensile wire of the wire mesh panels, and/or the tie wires/wire clips, is formed from AISI 316 or AISI 318 stainless steel. Optionally, the high tensile steel wire has a corrosion-resistant coating, such as an aluminium-zinc alloy coating, for example a coating comprising about 95% Zn and 5% Al. Optionally, such a coating is present in an amount of at least 90 g/m$^2$, such as at least 100 g/m$^2$, for example at least 125 g/m$^2$. Corrosion resistant wire, especially stainless steel wire is especially useful in harsh outdoor environments, for example at coastal locations. Stainless steel components provide exceptional durability and lessen the environmental impact of the erosion prevention system. In particular, the longevity of stainless steel helps to avoid frequent maintenance and/or replacement of erosion prevention infrastructure, thus avoiding disturbance of the natural environment. Furthermore, the corrosion resistance of stainless steel also helps to avoid contamination of the natural environment by pollutants released during decomposition of conventional construction materials (such as concrete and/or conventional steel products).

Optionally, the wire mesh has openings with a width of 40-120 mm and a length of 60-200 mm, such as a width of 60-100 mm, and a length of 80-150 mm. The length of an opening is measured across the maximum diameter of the opening and width is measured perpendicular to the length across the plane of the mesh.

Preferably, the wire mesh is a woven or knitted mesh. In contrast to welded mesh, woven and knitted meshes offer greater internal flexibility. In a welded mesh, used for forming conventional gabion baskets, the wires forming the mesh tend to be arranged in a grid pattern, welded at every overlap. Such mesh sheets have very high rigidity. Consequently, it has been found that individual gabion baskets, even when joined together at multiple points, behave as individual rigid blocks. It has now been found that using a more flexible mesh can allow some distortion of cell shape when the erosion prevention system is subjected to external forces. More particularly, it has now been found that when woven and knitted meshes are used to form cells, distortion of cells due to movement of the contained rock pieces and/or ground underneath increases tension across the mesh throughout the system, increasing its strength and resilience against further external forces. The greater the strength and resilience of the erosion prevention system, the more effective it is, and the less maintenance it requires. Reduced maintenance saves cost and helps to reduce invasive interventions that can disrupt and damage the ecology of the installation site. Preferably, the wire mesh is chain-link wire mesh. Chain-link wire mesh, also referred to as diamond pattern woven wire mesh, is made up of a plurality of interlaced wires that all extend in the same general direction across the plane of the mesh. The wires are bent into a zig-zag pattern, so that each "zig" hooks with the wire immediately on one side and each "zag" with the wire immediately on the other, forming quadrilateral shaped openings. It will be understood that each pair of interlaced wires define a row of mesh openings extending across the width of the mesh. Optionally, the openings have an elongated diamond, or rhomboid shape. Chain-link wire mesh is distinct from other types of woven mesh in which wires are twisted together to wrap around each other by one or more complete turns at each intersection. An example of such mesh is hexagonal pattern mesh, similar in structure to mesh commonly referred to as "chicken wire". An example of such mesh is PVC coated steel wire mesh available from Maccaferri®. While such hexagonal pattern mesh may be used as the mesh forming the cells of the present invention, it has been found that chain-link mesh provides better flexibility within the sheet, and may be made more easily from high tensile strength wire. Optionally, when the mesh is a woven or knitted wire mesh, the cut ends of each wire are knotted, for example knotted together to close the row of mesh openings running along an edge of the mesh. Optionally, the cut end of each wire is knotted into a loop that interlocks with a corresponding loop on the cut end of an adjacent wire. Optionally, the mesh forming the side panels of the cell are oriented with the mesh edges having knotted wire ends running along the edges between sides and the lid panel, and between the sides and the base panel. An especially useful form of wire mesh is TECCO® wire mesh provided by GEOBRUGG®.

Optionally, the cell assembly comprises a plurality of brace assemblies tying wire mesh extending across the lower face of the cell assembly to wire mesh extending across the upper face of the cell assembly (e.g. a vertical brace assembly). Additionally or alternatively, each cell optionally comprises at least one brace assembly tying wire mesh extending across the bottom of the cell to wire mesh extending across the top of the cell (e.g. a vertical brace assembly). Optionally each such brace assembly comprises a lower brace plate disposed below wire mesh at the bottom, an upper brace plate disposed above wire mesh at the top, and a tensioning member (e.g. tensioning cable) joining the lower brace plate to the upper brace plate. Preferably, the brace assembly is configured to allow the member to be tensioned, providing a positive force pulling the brace plates together. Preferably, the member is securely attached to the lower brace plate by any suitable fixing. Preferably, each brace plate is a metal plate, such as a steel (e.g. stainless steel) plate having a thickness of at least 5 mm, such as at least 8 mm and a minimum diameter of at least 150 mm, such as at least 200 mm (e.g. the plate is a flat square plate at least 8 mm×at least 200 mm×at least 200 mm, or the plate is a flat circular plate at least 8 mm×200 mm), optionally having a maximum diameter of no more than 500 mm, such as no more than 400 mm. Optionally, the tensioning member passes through a hole in the upper brace plate, and is held in place by a retainer (e.g. clip or nut) fastened to the member above the upper plate (the retainer being sized so that it cannot pass through the hole). Optionally, each cell comprises at least one corresponding horizontal brace assembly tying wire mesh extending across the first side to wire mesh extending across the opposing second side of the cell assembly (or cell). The or each clip in any brace assembly may be a one way clip that allows the clip to slide down/inwards along a tensioning cable as the upper/second plate is pushed towards the lower/first plate, and prevents the clip moving back up/outwards along the cable when the force pushing the upper/second plate is removed. It will be appreciated that both brace plates of any brace assembly may be arranged with the tensioning member passing through a hole in the brace plate and retained in place with a retainer (e.g. a one-way clip or nut). In such an arrangements, the member may extend outwards from the top and bottom, or both opposed sides, of the cell. The tensioning member may be, or may comprise a cable. Additionally or alternatively, the tensioning member may comprise or be a threaded bar (e.g. having a retaining nut for connecting the tensioning member to the upper/second brace plate). When the tensioning member comprises both one or more cables and a threaded bar, an end of the cable may be attached to the lower/first brace plate and the other end to a threaded socket sized to threadably receive an end of the threaded bar, and the upper/second brace plate comprises a through-hole sized to receive the other end of the threaded bar without allowing passage of the retaining nut when threaded onto the bar on the outside of the upper/second brace plate. Suitable bracing assemblies include those manufactured by Platipus® and Tecni®. Optionally, one or more of the brace assemblies is configured for attachment to an anchoring device (such as a ground anchor and/or another corresponding cell assembly) and/or a lifting device (such as a crane attachment), for example to provide a convenient lifting and/or anchoring point for the cell. When a cell is anchored to a corresponding cell, the brace assemblies of the cells may be configured for attachment to each other, for example, which may permit convenient fastening together of cells (e.g. when cells are installed in an underwater location). Optionally, the cell is suspendable and/or anchorable by one or more brace assemblies when partially or completely filled with rock pieces. Optionally, an end of the tensioning member (e.g. the end configured to protrude through a hole in a brace plate) is configured for attachment to, or attached to, an anchoring device and/or a lifting device. Additionally or alternatively, when the tensioning member comprises a threaded bar, the tensioning member may comprise an additional cable attached to the threaded bar, e.g. by another threaded socket fastened to the cable, which may act as an anchoring and/or lifting cable. Such a cable may be configured for attachment to an anchoring device and/or lifting device. It will be appreciated that another cell assembly may act as an anchoring device.

Preferably, the cell assembly is configured for suspension from a lifting device (e.g. a lifting frame). Optionally, the tensioning members of a plurality of brace assemblies (e.g. vertical brace assemblies) are configured for attachment to a lifting device. Additionally or alternatively, the cell assembly comprises a plurality of lift assemblies. Optionally, each lift assembly comprises a lift plate positioned below the lower surface of the cell assembly, and a lift cable secured to the lift plate and extending upwards through the cell assembly and outwards from the upper face. Preferably, each lift cable is configured for attachment to a lifting device, such as a lifting frame. Cables may be configured for attachment to a lifting frame, for example, by having a collective strength sufficient to bear the weight of the cell assembly, by being fitted with at least one connector for attachment to a lifting frame. It will be appreciated that a lift assembly may be substantially identical to a brace assembly, except that one of the two brace plates is omitted. While a lift assembly may have fewer components, it has been found that a brace assembly can provide for increased stability, for example because the second brace plate can help hold the brace assembly in a fixed position and orientation. Preferably, the cell assembly comprises at least four, such as at least eight, for example at least twelve, vertical brace assemblies and/or lift assemblies each configured for attachment to a lifting device such as a lifting frame, e.g. wherein the cell assembly is suspendable from the lifting device solely by said brace assemblies and/or lift assemblies when the cell assembly is filled with fill material such as rock pieces. Optionally, the filled cell assembly has a total mass of at least 2,000 kg, such as at least 4,000 kg, preferably at least 6,000 kg. Optionally, the filled cell assembly has a mass of from 1,000 kg to 20,000 kg, such as 2,000 kg to 15,000 kg, preferably 6,000 to 10,000 kg. Such a lifting arrangement may facilitate particularly convenient transport and installation. It will be appreciated that a bar, such as a threaded bar, could be used in conjunction with or in place of a cable in a brace assembly or lift assembly (e.g. such a rod may be equivalent to a cable, providing the same function).

Preferably, each cell is filled with rock pieces, such as rock pieces having a cross-sectional size in all dimensions larger than the cross-sectional size of the wire mesh openings. It will be understood that rock pieces often have irregular shapes, so even when filled with rock pieces, the interior of the cell may include large numbers of voids between rocks. Such voids could be filled with smaller rock pieces and/or granular material such as sand and/or soil. Additionally or alternatively, each cell may be filled with concrete pieces, for example to re-use concrete debris (if such a material is suitable for use at the installation location). The voids between rock pieces and optionally the voids between smaller rock pieces and granular material, can provide a porous structure through which wave energy may be dissipated. For example, when a wave impacts the erosion prevention system, water is able to fall between the rock and granular material into the voids. This can reduce the amount of water deflected by the erosion prevention system, for example beyond/behind the top of the system, thus reducing the amount of scour caused by water flowing back to its source. This porosity allows the erosion prevention system to behave in a similar manner to natural structures, helping the system to blend into the natural environment. In combination with the use of a wire mesh having high flexibility (especially enhanced when the wire mesh is chain-link mesh) and durability (particularly pronounced when the wire mesh is formed from stainless steel wire), the rock-piece filling of the cells allows the erosion prevention system to shift and settle over time, becoming integrated with the natural environment and allowing vegetation and granular material such as sand to build up and complement the structure.

Optionally, each cell comprises a water permeable fines barrier for preventing passage of granular material therethrough, such as soil and/or sand. Optionally, the fines barrier is configured for retention of granular material having a diameter of less than 5 mm, such as less than 2 mm, for example less than 1 mm. Optionally, the fines barrier is configured to retain granular material having a diameter of at least 0.07 mm, such as at least 0.1 mm. Optionally, the fines barrier allows smaller material to pass through. Thus, the fines barrier may be a soil and/or sand barrier, and optionally not a silt barrier. When present, the fines barrier is located inside the cell, extending across the entire cross-section of the cell at a position intermediate the top and bottom of the cell. Accordingly, the optional fines barrier is disposed below the lid panel of each cell. Preferably, when present, the fines barrier is positioned immediately beneath the wire mesh at the top of the cell. It has been found that a fines barrier can be used to help retain granular material such as sand and/or soil in the cell. A sand and/or soil containing cell may optionally contain rock pieces as well as sand and/or soil, depending on the requirements at the site requiring erosion prevention. Optionally, each cell contains granular material such as sand and/or soil, and optionally rock pieces, such as rock pieces having a cross-sectional size in all dimensions larger than the cross-sectional size of the wire mesh openings, wherein the granular material is disposed below, or located in a space enclosed by, the fines barrier. It will be appreciated that when a fines barrier is in the form of a layer extending across the cell towards the top, fines may be disposed below the barrier. When the fines barrier is, for example, in the form of a bag, fines may be located in a space enclosed by the fines barrier (thus inside the bag). Optionally, the fines barrier lines the sides and ends of said cell adjacent the wire mesh, and optionally the bottom of said cell adjacent the wire mesh. A fines barrier lining the top, bottom, sides and ends of the cell may help to prevent granular material moving between cells, which over time could lead to a concentration of fines in localised parts of the erosion prevention system. Optionally, the fines barrier is in the form of a bag having a bottom lining the bottom of said cell, sides lining the sides and ends of said cell, and a top flap lining the top of said cell. It will be appreciated that a top flap is optional, depending on the intended use of the cell assembly. A bag has been found to be particularly convenient to position in the cell and fill with material once in place. Preferably, the lid is sized and configured to overlap the sides of the bag, for example by at least 150 mm, such as at least 200 mm, for example at least 250 mm, on each side. Optionally, the lid is larger than the top of the cell, so that the edges of the lid can be pushed down alongside the sides. Additionally or alternatively, the sides of the bag are taller than the sides and ends of the cell so that they can be folded over the top of the cell. Preferably, the fines barrier is formed from a biodegradable material, such as a synthetic or natural biodegradable material. Suitable synthetic biodegradable materials include biodegradable plastics. Preferred are natural biodegradable materials, which typically have a lower environmental impact. Suitable natural biodegradable materials include jute fibre, hemp fibre, coconut fibre, straw and sheep wool. Optionally, the biodegradable material comprises sheep wool. Alternatively, the fines barrier may optionally be formed from a non-biodegradable material, such as a concrete blanket. Optionally, the fines barrier is formed form a geotextile material. Optionally, each cell comprises a plurality of live plants, such as live grass plants, and/or plant seed, such as grass seed. It will be appreciated that the choice of live plants depends on the environment in which the system is located. Especially useful plants are those that are capable of establishing extensive root systems in a relatively short time. Extensive root systems are thought to help stabilise installations, for example helping to establish artificial sand-dunes and/or riverbanks. When the cells comprise live plants, the live plants are preferably positioned with roots disposed at least partially below, or located in a space enclosed by, the fines barrier. It will be appreciated that, for example, such roots may be so disposed or located initially, while over time roots may penetrate the barrier as the plants grow. Preferably, the fines barrier is configured to allow roots to penetrate the barrier. Examples of suitable plants include herbs and grasses, such as *Ammophila* (a genus of grasses know as marram grass). Optionally, the fines barrier includes a plurality of openings into which live plants can be inserted, preferably slit openings. Such slit openings may provide a convenient way for plants to be added to cells after they have been filed and closed. When the cells comprise plant seed, the seed is preferably disposed below the fines barrier. Additionally or alternatively, seeds may be incorporated in the fines barrier itself, for example wherein the fines barrier is impregnated with seed. Providing plants and/or seed in the erosion prevention system stimulates the formation of a natural protective covering over the erosion prevention system. When a biodegradable fines barrier is utilised, the fines barrier acts to retain granular fill while plants are establishing, so that by the time the barrier naturally decays, the plants take over the role of retaining granular material in the cells. Such a system is particular effective for promoting formation of sand dunes in environmentally sensitive sites. When an erosion prevention system comprises a combination of a stainless steel wire mesh, natural biodegradable fines barrier and live plant/plant seed incorporation, the system provides an especially environmentally friendly, long-lasting form of erosion barrier.

Optionally, each cell comprises a plurality of different fill materials. For example, each cell may comprise a first layer of a first fill material, and a second layer of a second fill material, the second layer disposed above the first layer. Optionally, the first and second fill materials are rock pieces (e.g. aggregates), for example rock pieces (e.g. aggregates) of different sizes. Optionally, the first and second fill materials are rock pieces, the rock pieces of the second fill material having a smaller maximum diameter than the rock pieces of the first fill material. Optionally, each cell comprises a divider membrane separating the first fill material from the second fill material, for example wherein the divider membrane is a geotextile material. Optionally, each cell additionally comprises at least one fines barrier as described herein, for example the first and second fill materials, and the divider membrane if present, are optionally disposed inside a fines barrier bag that lines the cell. It will be appreciated that the choice of rock pieces (e.g. aggregate) may depend on the intended function and installation location of the cell assembly.

Optionally, the cell assembly comprises a strengthening grid positioned inside one or more cells, e.g. in each cell. Optionally, the strengthening grid is a rigid wire mesh, such as a welded wire mesh (e.g. as commonly referred to as reinforcement mesh). Preferably, the rigid mesh is a grid of steel rods (such as ribbed steel rods) having a first layer of parallel spaced apart rods ("longitudinal wires") overlaid by a second layer of parallel spaced apart rods ("cross-wires"), the rods of the second layer being oriented perpendicular to rods of the first layer and being welded to the rods of the first layer at each intersection. Preferably, the rods have a diameter of at least 8 mm, such as at least 10 mm, for example at least 12 mm, and/or the parallel rods have a spacing of no more than 250 mm, such as 200 mm, for example 150 mm, optionally 100 mm. An example of a suitable wire mesh is A393 mesh. Preferably the wire mesh is a stainless steel (e.g. austenitic stainless steel) wire mesh. It may be that a strengthening grid helps to stiffen the cell assembly, e.g. allowing the cell assembly to be lifted more conveniently once fully or partially filled with rock pieces. Optionally, the strengthening grid extends across at least a portion of the interior of the cell assembly, for example in a plane parallel to the bottom face. Optionally, the strengthening grid extends across at least 50%, such as at least 75%, for example at least 90%, of first and/or second widths of the cell, the first internal width being the distance between opposed ends, and the second between opposed sides, of the cell. Additionally or alternatively, the strengthening grid extends across at least 25%, such as at least 50%, for example at least 90%, of the internal area of the cell in a plane parallel to the bottom face of the cell assembly. Optionally, the strengthening grid is spaced apart from the top and/or bottom face of the cell assembly, e.g. separated by fill material (e.g. rock pieces), such as separated from the top and/or bottom face of the cell assembly by at least 25%, such as at least 40%, e.g. about 50%, of the average distance separating the top and bottom faces of the cell assembly. Alternatively, the strengthening grid is positioned against the inside of the bottom or top (preferably bottom) surface of the cell assembly. Optionally, the cell assembly comprises a single cell. Optionally, the cell assembly additionally comprises one or more (e.g. at least two) brace assemblies, for example vertical and/or horizontal brace assemblies as described herein, e.g. wherein each brace assembly is configured for attachment to a cell lifting device (such as a crane), e.g. as described herein. Optionally, the cell assembly comprises one or more (e.g. at least two) horizontal brace assemblies arranged below (e.g. immediately below) or threaded through the strengthening grid, and or one or more (e.g. at least two) vertical brace assemblies arranged to pass through the strengthening grid. It has been found that the strengthening grid may conveniently facilitate lifting of the cell assembly by the brace assemblies when fully or partially filled with rock pieces by reducing the tendency of the cell assembly to sag/distort. Additionally or alternatively, each brace assembly may be configured for attachment to the brace assembly of a neighbouring cell assembly, providing another means of securing cells together (especially useful when, e.g., cell panels do not overlap with panels of neighbouring cells).

According to a second aspect of the invention, there is provided a ground protection system comprising a plurality of cell assemblies according to the first aspect of the invention. For example, the erosion prevention system comprises a first cell assembly and a second cell assembly. Optionally, one or more of the cells forming the first cell assembly is arranged side by side one more cells forming the second cell assembly, for example wherein a side or end face of the first cell assembly abuts a side or end face of the adjacent cell assembly. Preferably, the cell assemblies are fastened together. It will be appreciated that assemblies may be fastened together by any suitable fastening. It will be appreciated that adjacent cell assemblies may be positioned abutting each other or spaced apart. Optionally, said side panels of abutting cell assemblies are fastened together by one or more tie wires and/or a plurality of clips. Optionally, adjacent cell assemblies are secured together by connecting one or more brace assemblies of each cell assembly to a brace assembly of an adjacent cell assembly. For example, the tensioning member of a brace assembly of a first cell assembly is fastened to a brace assembly of a second cell assembly. Any suitable fastening may be used. For example, one or both tensioning members so fastened may terminate in a connector facilitating connection to another tensioning member, and/or one or more separate fastening devices such as a cable clamp or crimp may be used to connect said cables. Additionally or alternatively, adjacent cell assemblies are joined together by fastening each cell assembly to a continuous sheet of mesh, such as chain link wire mesh, preferably wire mesh formed of the same type of material as the wire mesh forming the cell assemblies. For example, a single continuous sheet of chain link wire mesh may be fastened to the top of a first cell assembly and to the top of a second cell assembly. Any suitable fastening may be used, such as one or more tie wires, clips and/or helicoil fastenings described herein. Additionally or alternatively, adjacent cell assemblies (particularly when cell assemblies abut each other) are secured together by looping one or more tie wires around the adjacent assemblies, optionally wherein such tie wires are clipped to the cell assemblies and/or joined to one or more bracing assemblies. Preferably, the ground protection system is a ground protection system according to the claims.

Optionally, the ground protection system is an erosion prevention system. An example of an erosion prevention system is a coastal erosion prevention system, such as configured for installation on a coastline requiring erosion protection, for example configured for installation on a beach. Another example is a watercourse erosion prevention system, such as configured for installation along the side of a watercourse, for example configured for installation along a riverbank and/or embankment adjacent a river, canal or estuary. Another example is an underwater erosion prevention system, for example configured for installation on a river bed, lake bed or sea floor. It has been found that the cell assemblies of the present invention are useful for a wide variety of applications. In particular, it may be suitable for use in any ground protection role, for example providing structural support in foundations, embankments, cuttings and/or other earthworks. It will be appreciated that the cell assemblies may be covered by other materials, such as a surfacing material forming a road surface, a railway track bed, or a building or other structure base. Optionally, for example when the ground protection system is used for erosion prevention, the system may additionally comprise at least one scour prevention layer disposed below the cells. Optionally, the scour protection layer comprises a geotextile material. For example, such a geotextile material may be sandwiched between the cells and the surface of ground requiring protection. It will be appreciated that one or more additional structures may be positioned between the scour prevention layer and the ground. For example, the system may be laid over the top of pre-existing erosion control structures such as one or more geotubes. It has been found that incorporating a layer of geotextile material below the cells of the system can help to avoid ground being scoured from under the cells when water flows through and/or over the cells. Although water permeable geotextile materials allow water to pass through, large volumes of water falling on a geotextile material tend to flow across rather than through the geotextile, diverting water away from the ground under the cells without washing ground material, such as soil, sand or small rock and shingle away. Water permeable geotextile material may be woven or needle punched to provide pores that allow water to pass through.

Optionally, for example when the ground protection system is used for erosion prevention, the system may additionally comprise a water barrier layer disposed below the cells. Optionally, the water barrier layer comprises a semi-permeable or impermeable barrier material. Optionally, the barrier material comprises an impermeable geotextile material. Additionally or alternatively, the water barrier comprises a clay layer, such as a clay layer sandwiched between layers of geotextile material. An example of a suitable clay is bentonite. The geotextile material used in combination with a clay layer may itself be water permeable. It has been found that a water barrier layer is particularly useful when the erosion prevention system is used in watercourses, such as rivers or canals. In such settings, the system provides a dual function of protecting banks from erosion while also water-proofing the lining of the watercourse.

When a geotextile material layer is incorporated into the ground protection system, any suitable geotextile material may be used. For example, polymeric materials such as a polyolefin, e.g. polypropylene, or polyester based material. Optionally, the geotextile material is a water permeable geotextile. Water permeable geotextile materials are fabrics that can be used to retain soil, sand, small rock or shingle, or other fine material, while allowing water to pass through. Impermeable geotextile materials are fabrics that prevent passage of water therethrough. Suitable geotextile materials are available from Geosynthetics®.

It will be appreciated that the ground protection system of the second aspect of the invention may incorporate any feature described in relation to any other aspect of the invention, and vice versa. For example, overlapping sheets of adjacent cells may be fastened by at least one continuous fastening device, and/or at least one row of discrete fastening devices, e.g. as described above in relation to the first aspect of the invention.

According to a third aspect, there is provided a kit of parts comprising parts for forming a cell assembly, such as the cell assembly of the first aspect of the invention. The kit of parts comprises one or more chain-link wire mesh sheets for forming the first continuous length of chain-link wire mesh for defining the lower, end and upper faces of the cell assembly, and one or more additional continuous chain-link wire mesh sheet(s) for defining the first and second side faces of cell assembly. For example, the one or more additional sheets being for forming the second (and optionally third) continuous length of chain-link wire mesh of the cell assembly of the first aspect of the invention. Preferably, each additional continuous chain-link wire mesh sheet is arranged for defining a side face and at least partially wrapping around another adjacent face of the cell assembly. Optionally, the kit of parts comprises fastenings for securing together the wire mesh sheets, for example comprising tie wires and/or clips. Optionally, the kit of parts comprises a plurality of wire mesh panels (e.g. baffles) for defining sides, ends, top and/or bottom (preferably sides and/or ends) of the one or more cells forming the cell assembly. For example, the panels may be configured to subdivide the cell assembly into a plurality of cells. Preferably the kit of parts is a kit of parts according to the claims.

Optionally, the kit of parts comprises a plurality of brace assemblies for tying wire mesh forming the lower face of the cell assembly to wire mesh forming the upper face of the cell assembly (e.g. a vertical brace assembly). Additionally or alternatively, the kit of parts comprises a plurality of brace assemblies for tying the wire mesh defining the bottom to the wire mesh defining the top of each cell. Optionally, the kit of parts cell assembly comprises a plurality of brace assemblies for tying wire mesh forming a side or end face of the cell assembly to wire mesh forming an opposed side or end face of the cell assembly (e.g. a horizontal brace assembly). Optionally, each brace assembly comprises a pair of brace plates (e.g. for positioning outside a sheet of wire mesh) and a tensioning member for joining the brace plates together, and optionally one or more retainer(s) (such as one-way clip(s) or nut(s)) for holding the brace plate(s) in position on the tensioning member. For example, each vertical brace assembly may comprise a lower brace plate, an upper brace plate, and a tensioning member for joining the lower brace plate to the upper brace plate, and optionally a retainer (such as a one-way clip) for holding the upper brace plate in position on the tensioning member. It will be appreciated that each brace assembly may optionally comprise any feature described in relation to the brace assemblies of the first aspect of the invention. For example, a plurality of the brace assemblies may optionally be configured for suspending the cell assembly from a lifting device, such as a lifting frame, once the cell assembly is constructed and the cell(s) filled with fill material, as described in relation to the first aspect of the invention. Optionally, the kit of parts comprises a plurality of lift assemblies for suspending the cell assembly from a lifting device, such as a lifting frame, once filled with fill material. Optionally, each lift assembly comprises a lift plate and a lift cable securable to the lift plate and being connectable to a lifting device. For example, each lift cable may having a length sufficient to extend upwards through the cell assembly and outwards from the upper face once the cell assembly is constructed and the cell(s) filled with fill material. Preferably, each lift cable is configured for attachment to a lifting device, such as a lifting frame. Each lift assembly may incorporate any feature described in relation to the lift assemblies of the first aspect of the invention.

Optionally, the kit of parts comprises a lifting frame from which the cell assembly is suspendable from the lifting frame once the cell assembly is constructed and the cell(s) filled with fill material. Preferably, the frame comprises a plurality of cell attachment points for connection to tensioning members and/or lift cables of the cell assembly. Preferably, the cell attachment points are positioned to cooperate with the tensioning members/lift cables of the cell assembly. Preferably, the frame comprises a plurality of equipment attachment points for connection to lifting equipment, such as a crane. It will be appreciated that any form of suitable attachment point may be used, including for example attachment brackets and/or attachment cables/chains. Preferably, the frame is made from metal beams, such as rolled steel joists, secured together in any suitable manner (e.g. bolted and/or welded together). It has been found that such a lift frame may provide a particularly stable and balanced mechanism for lifting the cell assembly, allowing convenient transport and/or installation. For example, the frame may help to ensure that the tensioning members/lift cables extend away from the upper surface of the cell assembly approximately parallel to each other, helping to avoid undue distortion of the cell assembly. Additionally, it has been found that such a frame can be used to lift the cell assembly at an angle to the horizontal, allowing convenient positioning on sloping ground.

Optionally, the kit of parts comprises a forming frame for supporting the sides and ends of the cell assembly during construction and filling with fill material. Preferably, the forming frame is an open-topped frame sized to extend around the first and second sides, and first and second ends, of the cell assembly. For example, the frame optionally comprises an internal cavity having a width of 1-5 m (e.g. 2-4 m), a length of 1-5 m (e.g. 2-4 m), and a height of 0.15-1.5 m (e.g. 0.4-0.8 m). Optionally, the frame is an open-bottomed frame. Preferably, the frame defines a rectangular internal cavity. It has been found that such a frame facilitates convenient and reliably assembly and filling of the cell assembly. For example, during construction, the sheets of the cell assembly are laid inside the frame, with the top of the cell(s) open (i.e. with ends of the sheets forming the cell assembly folded out over the sides of the frame), then secured together. Fill material is inserted through the open top, and then the ends of the sheets drawn across the top to close the cell assembly. The cell assembly can then be lifted out of the frame ready for transport and/or installation.

Optionally, the kit of parts comprises at least one (e.g. a plurality of) water permeable fines barrier for preventing passage of sand and/or soil therethrough, the fines barrier being sized and configured for disposal inside the cell, optionally wherein each said fines barrier is sized and configured to line the top, bottom, sides and/or end(s) of the cell, optionally wherein each fines barrier is formed from a biodegradable material such as sheep wool, or coconut fibre based material, optionally wherein the kit of parts additionally comprises a plurality of live plants, such as live grass plants, and/or plant seed, such as grass seed. Optionally, the kit of parts comprises a scour prevention layer for disposal below the cell assembly.

According to a fourth aspect of the invention, there is provided a method of constructing a cell assembly, such as a cell assembly according to the first aspect of the invention. Optionally, the method comprises fastening the first continuous length of wire mesh for defining the lower, end and upper faces of the cell assembly to the continuous length(s) of wire mesh sheet for defining the side faces of the cell assembly, and optionally to a plurality of wire mesh panels (e.g. baffles) for forming the sides and/or ends of each cell, so that the at least one cell has an open top. The method further comprises inserting fill material into the at least one cell, and securing the first continuous length of chain-link wire mesh across the upper face of the cell assembly by fastening together the ends of the first continuous length of chain-link wire mesh sheet, and fastening the continuous length of chain-link wire mesh to said continuous length(s) of wire mesh sheet, thereby closing the at least one cell. Optionally, when the first and second sides are defined by a second continuous sheet of chain-link wire mesh, the method comprises fastening together the ends of the second continuous sheet of wire mesh. Preferably, the wire mesh sheets are fastened together using a plurality of clips and/or tie wires. Optionally, the method comprises positioning the wire mesh sheets in a forming frame before the step of fastening the sheets together, for example wherein free ends of the sheets are folded out over the sides of the forming frame. Optionally, the method comprises using the forming frame to control the shape of the cell assembly during filling. Optionally, the method comprises compacting fill material in the at least one cell before the step of closing the at least one cell. It has been found that a forming frame helps control the shape of the cell assembly, for example when the fill material is compacted.

Optionally, the first continuous sheet of mesh is tensioned when the ends are fastened together, and/or the mesh forming the first and second sides is tensioned when fastened to the first continuous sheet, and/or the second continuous sheet of chain-link wire mesh forming the first and second sides is tensioned when the ends are fastened together. The sheet(s) of the cell assembly may, for example, be tensioned as described in relation to the first aspect of the invention.

Optionally, the method comprises installing at least part of one or more brace assemblies into the at least one cell before the step of inserting fill material into the cell, and completing the brace assemblies after the step of closing the cell to tie the wire mesh defining the bottom to the wire mesh defining the top of the at least one cell. Optionally, the method comprises installing a plurality of lift assemblies in the cell assembly before the step of inserting fill material into the at least one cell. Optionally, the method comprises connecting the tensioning members and/or lift cables of the brace assemblies and/or lift assemblies of the cell assembly to a lifting device, such as a lifting frame, after the step of closing the at least one cell.

Optionally, the method comprises inserting into the at least one cell a water permeable fines barrier for preventing passage of sand and/or soil therethrough, either immediately before, during, or immediately after the step of inserting fill material into said cell. Optionally, each fines barrier is in the form of a bag, and the method comprises inserting each fines barrier into a cell before the step of inserting fill material, arranging the bag so that the bottom and sides of the bag line the bottom and sides of the cell, filling each bag with fill material thereby inserting fill material into the at least one cell, and closing the top flap of the bag over the fill material before the step of closing the cell. Optionally, the method comprises 1) adding plant seed to the fill material; and/or 2) inserting the roots of a plurality of live plants, such as live grass plants, and/or plant seed, such as grass seed, through openings in the top of the fines barrier before or after the step of closing the cells.

Optionally, the method comprises inserting a strengthening grid into the at least one cell, for example part-way through filling the cell with fill material.

According to a fifth aspect of the invention, there is provided a method of constructing a ground protection system, such as a ground protection system according to the second aspect of the invention. Optionally, the method comprises positioning a plurality of cell assemblies according to the first aspect of the invention on ground to be protected. Optionally, the method comprises securing the cell assemblies together. Optionally, the step of securing the assemblies together comprises connecting at least one brace assembly of each cell assembly to a brace assembly of another cell assembly, for example by connecting together tensioning members of said brace assemblies. Preferably the method of constructing a ground protection system is a method according to the claims.

Optionally, for example when the ground protection system is an erosion prevention system, the method comprises laying a scour prevention layer, and/or a water barrier layer on ground requiring protection, and then arranging the cell assemblies on top. Optionally, the method comprises grading the ground to be protected before laying down a scour protection layer/water barrier layer (if present).

Optionally, the method comprises lifting each cell assembly into place, for example by suspending each cell assembly from a lifting device, e.g. as described in relation to preceding aspects of the invention.

It will be understood that any aspect of the invention may optionally incorporate any feature described in relation to another aspect of the invention. For example, the base panel and at least one side panel of the cells/cell portions of the sixth, seventh, eighth, ninth and tenth aspects of the invention may optionally be formed from a continuous length of wire mesh, as described in relation to the first, second, third and fourth aspects of the invention. Optionally, the top panel of said cells/cell portions may also be formed from the continuous length of wire mesh forming the bottom panel and at least one side panel. Similarly, the wire mesh panels forming the base and at least one side (and optionally the top) of the cells of the sixth aspect of the invention may optionally be formed from a continuous length of wire mesh, as described in relation to the first, second, third and fourth aspects of the invention. Furthermore, it will be understood that the cell assembly of the first aspect of the invention may optionally form part of a stack of cells, e.g. wherein the cell assembly is placed on top of a stack of cells where the top of each cell in layers below the top layer of the stack is closed by the mesh forming the bottom of the cell immediately above. Similarly, it will be appreciated that the cell assembly may optionally include multiple layers of stacked cells, for example wherein the continuous length of mesh defining the lower and upper faces of the cell assembly form the bottom of any cell(s) at the bottom of the stack and the top of any cell(s) at the top of the stack.

DESCRIPTION OF THE DRAWINGS

Embodiments of the present invention will now be described by way of example only with reference to the accompanying schematic drawings of which:

FIGS. 3*a-e* show various views of a cell assembly, during and after construction;

FIGS. 4*a-e* show various views of another cell assembly, during and after construction;

DETAILED DESCRIPTION

Figure 1A:
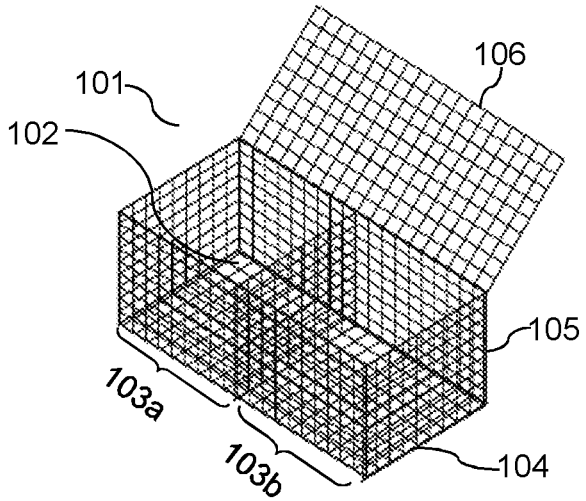
Fig. 1a (Prior Art)
FIGS. 1*a* and 1*b* show prior art gabion designs.
Figure 1B:
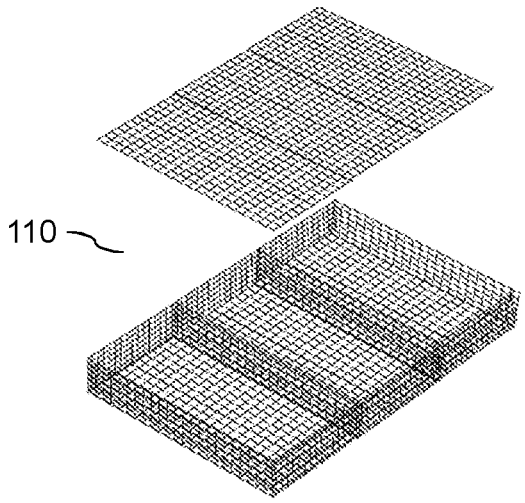
Fig. 1b (Prior Art)
Figure 2A:
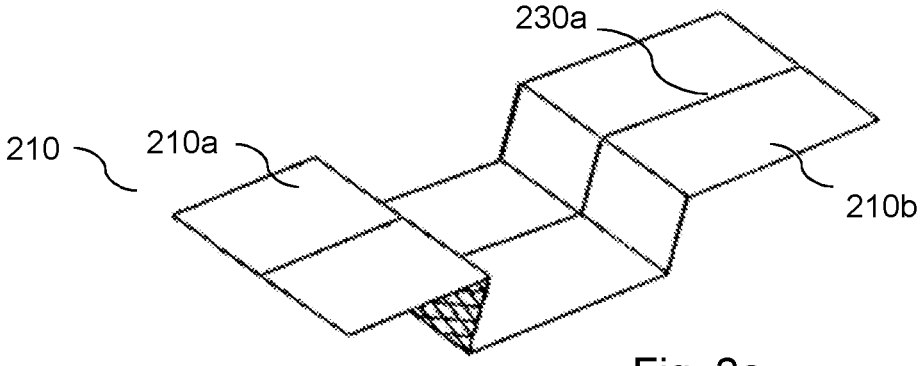
FIGS. 2*a-c* show various views of a cell assembly during construction.
Figure 2B:
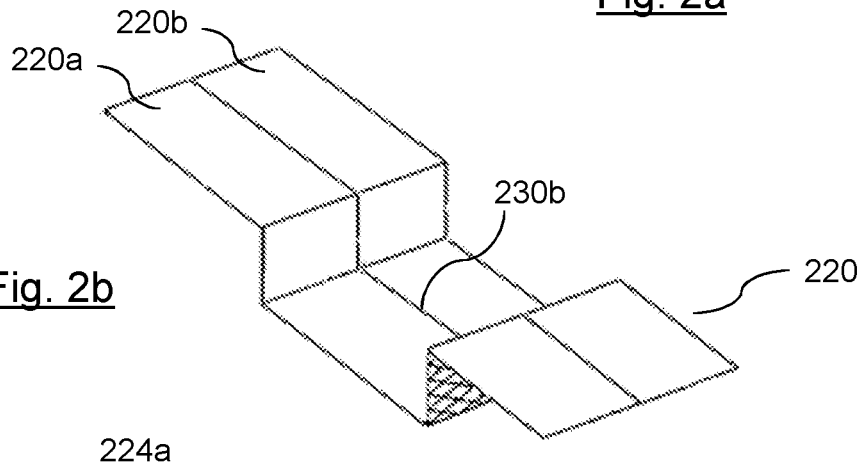
Figure 2C:
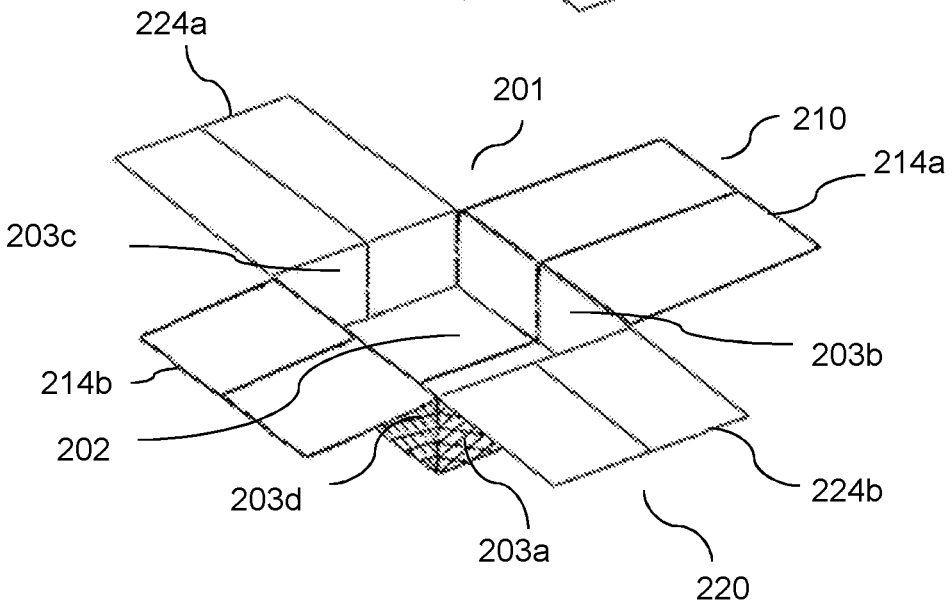

FIGS. 2*a-c* show exploded and partially constructed views of a cell assembly 201 according to the invention. Cell assembly 201 is a single cell assembly comprising a one cell. The cell assembly 201 has a lower face 202, two opposed side faces 203*b* and 203*d*, and two opposed end faces 203*a* and 203*c*. The cell assembly 201 is formed from two overlapping continuous lengths of wire mesh 210, 220 shown separately in FIGS. 2*a* and 2*b*, respectively. A first length of mesh is formed from two single continuous sheets 210*a*, 210*b* joined together side to side by an overlapping join 230*a*, and a second length of mesh is formed from two single continuous sheets 220*a*, 220*b* joined together side to side by an overlapping join 230*b*. Once the two sheets 210, 220 are put together to form the cell assembly 201, sheet 210 wraps around the lower face 202 and the two opposed side faces 203*b*, 203*d*, and sheet 220 wraps around the lower face 202 and the two end faces 203*a*, 203*c*. Sheets 210*a*, 210*b* of length 210 each wrap around and span lower face 202 and the two opposed side faces 203*b*, 203*d*, and each sheet is joined to itself end to end by an overlapping join. Similarly, sheets 220*a*, 220*b* of length 220 each wrap around and span lower face 202 and the two opposed end faces 203*a*, 203*c*, and each sheet is joined to itself end to end by an overlapping join. The cell assembly 201 is shown in FIG. 2*c* in a partially constructed state, with the top of the cell open. To close the cell, the ends 214*a*, 214*b* of sheet 210, and the ends 224*a*, 224*b* of sheet 220 are folded in over the upper face of the cell, with the opposing ends of sheets 210 and 220 overlapping in the middle. Once closed, cell assembly 201 has at least a double layer of mesh entirely across the lower face 202, and across the upper face. Fastenings, e.g. helicoil fastenings, may be used between sides of the sheets at edges of the cell. In FIGS. 2*a-c*, the wire mesh forming the cell is a diamond pattern, chain link, wire mesh, shown only on end 203*a* and side 203*d* for clarity. Each sheet 210*a*, 210*b*, 220*a*, 220*b* is made up of a plurality of interlaced, zig-zag shaped wires that extend from one side of the sheet to the other in a general direction parallel to each other and parallel to the ends of the sheets.

FIGS. 3*a-c* show exploded and partially constructed perspective views of a cell assembly 301 according to the invention. FIG. 3*d* shows a top plan view of the cell assembly 301, and FIG. 3*e* shows a perspective view of the cell assembly 301 when complete (except that the rock filling is not shown for clarity). Cell assembly 301 is a single cell assembly comprising a one cell. The cell assembly 301 has a lower face 302, two opposed side faces 303*b* and 303*d*, and two opposed end faces 303*a* and 303*c*. The cell assembly 301 is formed from two overlapping continuous sheets of wire mesh 310, 320, shown separately in FIGS. 3*a* and 3*b*, respectively. Once the two sheets 310, 320 are put together to form the cell assembly 301, sheet 310 wraps around the lower face 302 and the two opposed side faces 303*b*, 303*d*, and sheet 320 wraps around the lower face 302 and the two end faces 303*a*, 303*c*. The cell assembly 301 is shown in FIG. 3*c* in a partially constructed state, with the top of the cell open. To close the cell, the ends 314*a*, 314*b* of sheet 310, and the ends 324*a*, 324*b* of sheet 320 are folded in over the upper face of the cell, with the opposing ends of sheets 310 and 320 overlapping in the middle. It will be appreciated that sheet 310 may be located inside sheet 320, outside sheet 320, or inside sheet 320 on the lower face and outside sheet 320 on the upper face (and vice versa). The structure of cell 301 has a double layer of mesh across the lower face 302, and at least a double layer across the upper face (with four layers of mesh across at least a portion of the upper surface). FIG. 3*d* shows the four-way overlap created when the top of the cell is closed to form overlapping join 330, where the overlapping sheets are joined by a suitable fastening device, such as a helicoil fastener. Fastenings, e.g. helicoil fastenings, may be used between sides of the sheets at edges of the cell. The brace assemblies 340 are positioned to pass through the four way overlapping join 330, strengthening the overlapping join. FIGS. 3*a-e* show cell 301 with both continuous sheets overlapped on the upper face of the cell. It will be appreciated that the two sheets need not overlap on the same face. For example, overlaps between sheets could be formed on the side or end faces instead. In FIGS. 3*a-e*, the wire mesh forming the cell is a diamond pattern, chain link, wire mesh, shown only on end 303*a* and side 303*d* for clarity. Each sheet is made up of a plurality of interlaced, zig-zag shaped wires that extend from one side of the sheet to the other in a general direction parallel to each other and parallel to the ends of the sheets. The diamond shaped openings of the mesh have lengths greater than their widths, forming an elongate diamond. In FIGS. 3*a-e*, the meshes of both sheets 310, 320 are oriented with the length axis of the diamonds parallel the bottom of the cell. Other mesh shapes could be used, e.g. the diamonds could have their length axis perpendicular the bottom of the cell, as would be the case using the mesh of FIG. 5*a*. FIGS. 3*a-e* show cell 301 with the sheets 310, 320 forming a double layer on the lower and upper faces of the cell. Alternative constructions include having mesh 310 extend only across the lower and side faces (and not the upper face), and/or having mesh 310 turned to wrap the side and end faces of the cell rather than the lower, side and upper faces. It will be appreciated that the opposed ends of, e.g., the sheet 310 need not overlap each other, for example provided that they overlap with the other sheet 320 (and vice versa). Four brace assemblies 340 are shown in FIGS. 3*d-e* to give an indication of their positions once the cell assembly is constructed.

FIGS. 4*a-e* show various views of another cell assembly 401 according to the invention. Cell assembly 401 is similar to cell assembly 301 of FIGS. 3*a-e*, except that it is formed from three overlapping continuous sheets of wire mesh 410*a*, 410*b*, and 420, shown separately in FIGS. 4*a* and 4*b*, respectively. Features the same as those in FIGS. 3*a-e* are given corresponding reference numerals, prefixed '4' instead of '3'. Once the three sheets 410*a*, 410*b*, 420 are put together to form the cell assembly 401, sheet 410*a* defines the first side face 403*b*, sheet 410*b* defines the second side face 403*d*, and sheet 420 wraps around the lower face 402 and the two end faces 403*a*, 403*c*. The cell assembly 401 is shown in FIG. 4*c* in a partially constructed state, with the top of the cell open. To close the cell, the ends 414*a*, 414*b* of sheets 410*a*, 410*b*, and the ends 424*a*, 424*b* of sheet 420 are folded in over the upper face of the cell, with the ends 414*a*, 414*b* of sheets 410*a*, 410*b* and the opposing ends of sheet 420 overlapping in the middle. It will be appreciated that sheets 410*a*, 410*b* may be located inside or outside sheet 420 on the upper face. The structure of cell 401 has a single layer of mesh across the lower face 402, and at least a double layer across the upper face (with four layers of mesh across at least a portion of the upper surface). FIG. 4*d* shows the four-way overlap created when the top of the cell is closed to form overlapping join 430, where the overlapping sheets are joined by a suitable fastening device, such as a helicoil fastener. Fastenings, e.g. helicoil fastenings, may be used between sides of the sheets at edges of the cell. The brace assemblies 440 are positioned to pass through the four way overlapping join 430, strengthening the overlapping join. FIGS. 4*a-e* show cell 401 with all three sheets overlapped on the upper face of the cell. The wire mesh forming the cell is a diamond pattern, chain link, wire mesh, shown only on end 403*a* and side 403*d* for clarity.

The cell assemblies of FIGS. 3*a-e* and 4*a-e* are each suitable for defining the bottom and sides of a cell having a width of 3.25 m, a length of 3.25 m and a height of 0.75 m. The wire mesh forming the panels is Geobrugg® TECCO® high-tensile steel wire mesh G65/3 stainless, having a wire diameter of 3.0 mm, and a wire tensile strength of at least 1,650 N/mm$^2$, formed from AISI 318 stainless steel. The mesh tensile strength is at least 140 kN/m. The diamond openings are 143 mm long, and 83 mm wide. Other wire meshes could be used, including Al/Zn coated steel wire mesh, such as other Geobrugg® TECCO® products.

Figure 5A:
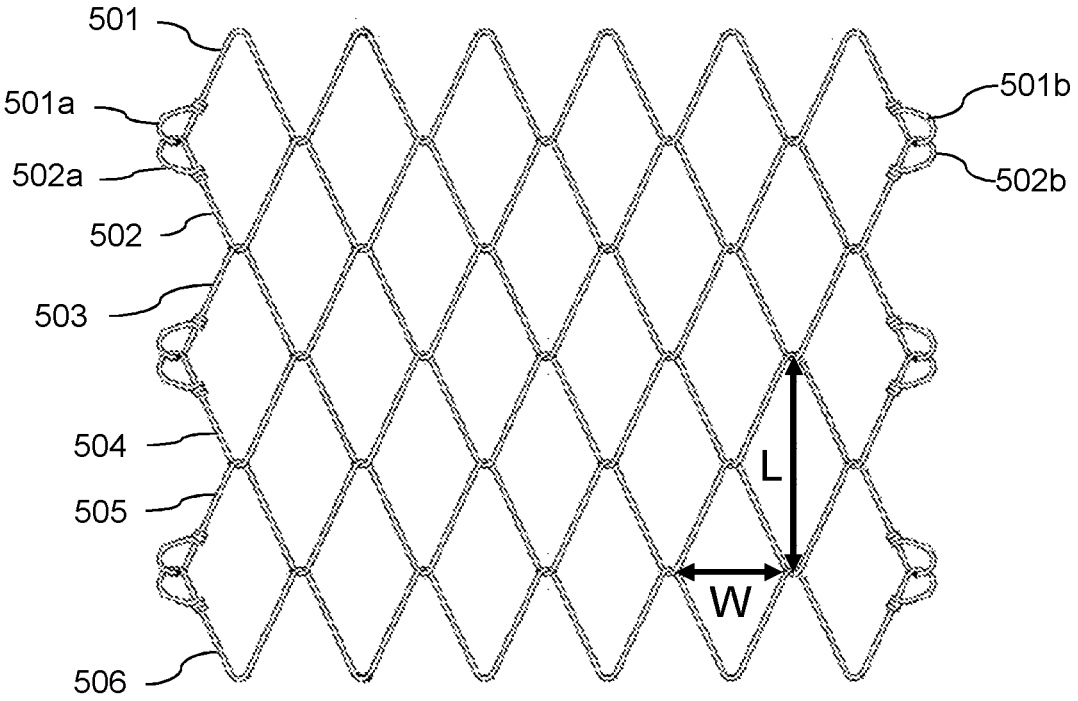
FIG. 5*a* shows a top plan view of a wire mesh for use in the assembly of the invention.
Figure 5B:
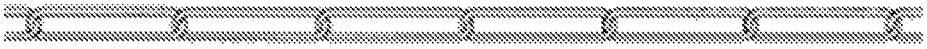
FIG. 5*b* shows a side view of the wire mesh of FIG. 5*a;*

FIG. 5*a* shows a top plan view of a wire mesh suitable for use in the cell assembly of the invention. Shown in FIG. 5*a* is Geobrugg® TECCO® mesh. Optionally, the mesh is G65/3 STAINLESS TECCO® mesh. The mesh is a chain-link woven mesh having a diamond pattern, with each diamond opening having a length L greater than a width W. The mesh portion shown in FIG. 5*a* is made up of six zig-zag interlaced wires 501-506. The cut ends of each wire 501*a*, 502*b* are knotted and interlinked with the knotted cut ends of the adjacent wire 502*a*, 502*b*. FIG. 5*b* shows a side view of the wire mesh of FIG. 5*a*.

Figure 6A:
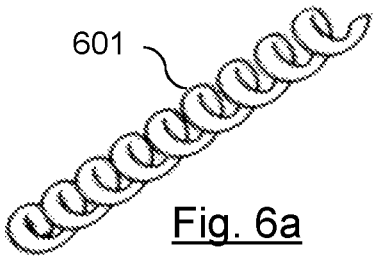
FIG. 6*a* shows a helicoil fastening for fastening together panels of wire mesh.
Figure 6C:
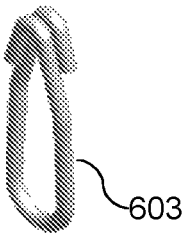
FIG. 6*c* shows a spring clip suitable for fastening together panels of wire mesh.
Figure 6B:
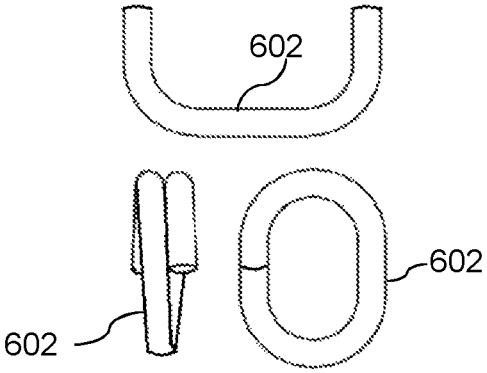
FIG. 6*b* shows a c-clip for fastening together panels of wire mesh.

FIG. 6*a* shows a helicoil fastening 601 suitable for fastening together panels of wire mesh. In use, the helicoil fastening 601 is wound around the wires of two adjacent mesh panels to link the panels together. FIG. 6*b* shows a c-clip 602 suitable for fastening together panels of wire mesh. The c-clip is shown in two configurations—open (before being used to fasten panels together, when the clip has a 'c' shape), and closed (after being secured around a pair of adjacent wires to fasten wires together, when the clip overlaps itself to form an 'o' shape). In FIG. 6*b*, the clip in its close configuration is shown in plan view and side view to show the overlapping clip ends. FIG. 6*c* shows a spring clip 603 suitable for fastening together panels of wire mesh. The clip shown is a T3 clip available from Geobrugg®.

Figure 7:
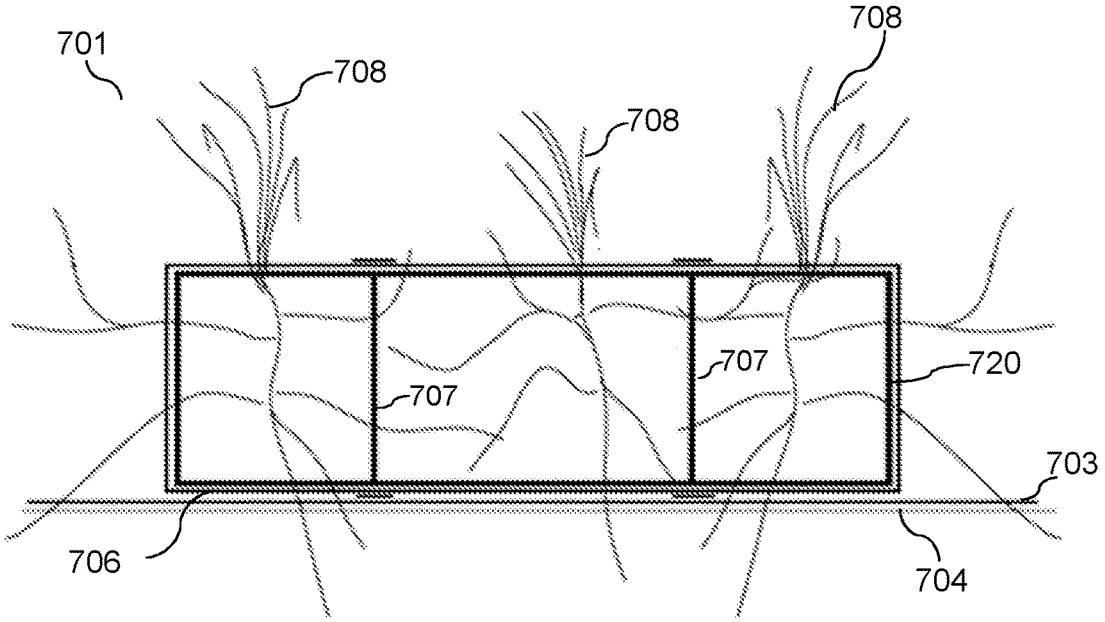
FIG. 7 shows a side cross-section view of a cell assembly fitted with a permeable barrier.

FIG. 7 shows a side cross-section view of a cell assembly 701 fitted with a water permeable fines barrier 720. The fines barrier is in the form of a bag that lines the bottom, sides and top of the cell 701. The fines barrier bag 720 is biodegradable, and formed from a sheep wool material, although other biodegradable materials could be used. It will be appreciated that in some installation locations, a non-biodegradable fines barrier bag may be appropriate. The fines barrier bag 720 is filled with sand, pushing the bag out against the panels defining the bottom and sides of the cell. FIG. 7 is a schematic view of a single cell 701, shown in position in an erosion protection system for clarity. Also shown in FIG. 7 is a scour prevention layer 703 comprising a (biodegradable or non-biodegradable) geotextile material. The scour prevention layer 703 is optional, but may assist in avoiding undermining of the cells in the event that water tracks along the bottom of the cells below the fines barrier bags 720. The scour prevention layer 703 is sandwiched between the cell 701 and the ground 704 requiring erosion prevention. A first continuous sheet of wire mesh wraps around the bottom, ends and top of the cell, and a second continuous sheet of wire mesh wraps around the bottom, sides and top of the cell. The cell 701 comprises a plurality of brace assemblies 707 that help keep the top and bottom of the cell in alignment with each other. FIG. 7 shows the cell 701 with a number of established live plants 708. If the cell is installed on land, examples if suitable plants include marram grass plants (which grow significant root systems that extend throughout the cell, into neighbouring cells (not shown in FIG. 7), and/or into the ground 704). Other plants may be used, e.g. if the cell is installed underwater. Plant root systems can stabilise the sand filling the cell, holding it in place as the fines barrier bag 720 naturally degrades. Marram grass plants may, for example, stimulate formation of a sand dune system over the base provided by the erosion prevention system.

Figure 8:
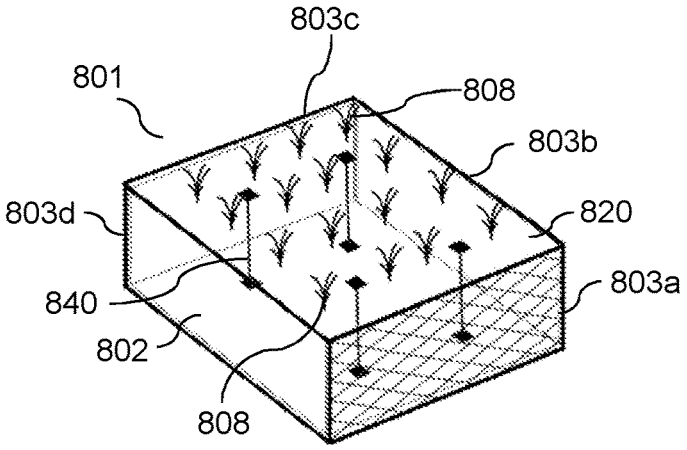
FIG. 8 shows a perspective view of a cell assembly fitted with a fines barrier bag filled with sand, soil, rocks or a mixture thereof.

FIG. 8 shows a perspective view of a cell assembly 801 similar to cell assemblies 301 and 401 of FIGS. 3 and 4, except that the cell assembly 801 is fitted with a fines barrier bag 820 filled with sand, soil, rocks or a mixture thereof. The features of the cell assembly 801 equivalent to those of cell assembly 301 are labelled with the same reference numerals as used in FIG. 3, prefixed '8' instead of '3'. FIG. 8 shows the position of sixteen plants 808 (only the tops of the plants are shown in FIG. 8). The plants protrude through slits in the top of the fines barrier bag 820 (not shown in FIG. 8).

Figure 9:
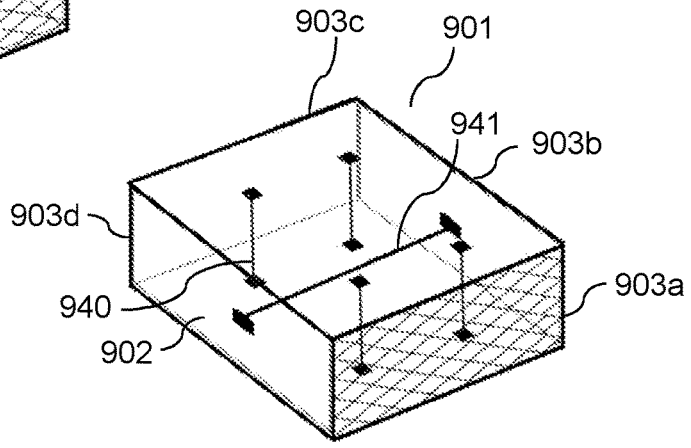
FIG. 9 shows a perspective view of a cell assembly having vertical and horizontal bracing.

FIG. 9 shows a perspective view of another cell assembly 901 similar to cell assemblies 301 and 401 of FIGS. 3 and 4, except that in addition to the vertical brace assemblies (labelled 940 in FIG. 9), the cell assembly 901 includes a horizontal brace assembly 941 tying together opposed side faces 903*b* and 903*d*. The features of the cell assembly 901 equivalent to those of cell assembly 301 are labelled with the same reference numerals as used in FIG. 3, prefixed '9' instead of '3'.

Figure 10:
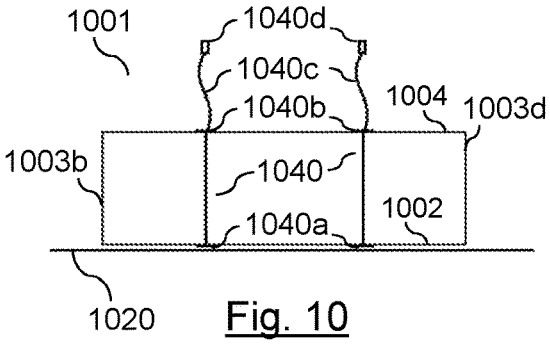
FIG. 10 shows a side cross-section view of a cell assembly positioned on the ground.

FIG. 10 shows a side cross-section view of a cell assembly 1001 similar to cell assemblies 301 and 401 of FIGS. 3 and 4, positioned on the ground 1020. The features of the cell assembly 1001 equivalent to those of cell assembly 301 are labelled with the same reference numerals as used in FIG. 3, prefixed '10' instead of '3'. The vertical brace assemblies 1040 each comprise a length of cable 1040*c* fastened at one end to a lower brace plate 1040*a* positioned below the mesh forming the bottom 1002 of the cell assembly 1001, and which passes through an upper brace plate 1004*b* positioned above the mesh forming the top 1004 of the cell assembly 1001. When the cell assembly is constructed, the cables 1040*c* are pulled tight and the upper brace plates 1040*b* are pushed down against the top 1004 of the cell assembly 1001 and held in pace with a one-way clip (not shown in FIG. 10). In FIG. 10, the free ends of the cables 1040*c* are shown terminating in connectors 1040*d* configured for connection to corresponding connectors on the ends of such cables in neighbouring cell assemblies. Alternatively, a single connector may be added to the free ends later, for example allowing an overlapping join between cable ends.

Figure 11:
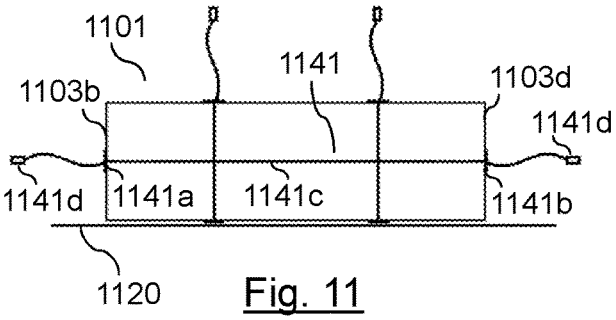
FIG. 11 shows a side cross-sectional view of another cell assembly identical to that of FIG. 10, except that it also comprises a horizontal brace assembly.

FIG. 11 shows a side cross-sectional view of another cell assembly 1101 identical to the cell assembly 1001 of FIG. 10 on the ground 1120, except that the cell assembly also comprises a horizontal brace assembly 1141. The horizontal brace assembly 1141 comprises a length of cable 1141*c* that passes through a first side bracing plate 1141*a* positioned outside the mesh forming the first side 1103*b* of the cell assembly 1101, and through a second side bracing plate 1141*b* positioned outside the mesh forming the second side 1103*d* of the cell assembly 1101. When the cell is constructed, the cables 1141*c* is pulled tight and the first and second side brace plates 1141*a*, 1141*b* are each pushed against the first and second sides 1103*b*, 1103*d* of the cell assembly 1001 and held in pace with one-way clips (not shown in FIG. 11). In FIG. 11, the free ends of the cables 1141*c* are shown terminating in optional connectors 1141*d* configured for connection to corresponding connectors on the ends of such cables in neighbouring cell assemblies, and/or for connection to an anchoring device (e.g. a ground anchor). In FIG. 11, the labels of vertical brace assemblies 1140 are omitted for clarity.

Figure 12:
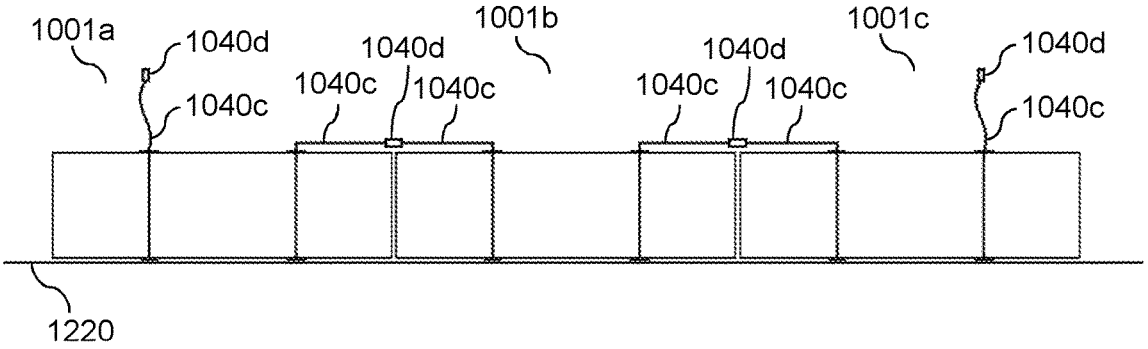
FIG. 12 shows a side cross-section view of three of the cell assemblies of FIG. 10 positioned adjacent each other and joined by their brace assemblies.

FIG. 12 shows a side cross-section view of three of the cell assemblies 1001 of FIG. 10 (labelled 1001*a-c* in FIG. 12) positioned adjacent each other on the ground 1220. The cell assemblies 1001 are joined together by connecting the free ends of the cables 1040*c* of the brace assemblies 1040 using cable-end connectors 1040*d*. Any suitable cable connecting device could be used. The free ends of the cables of brace assemblies of the two outer cell assemblies 1001*a* and 1001*c* are shown ready for connection to further cell assemblies.

Figure 13:
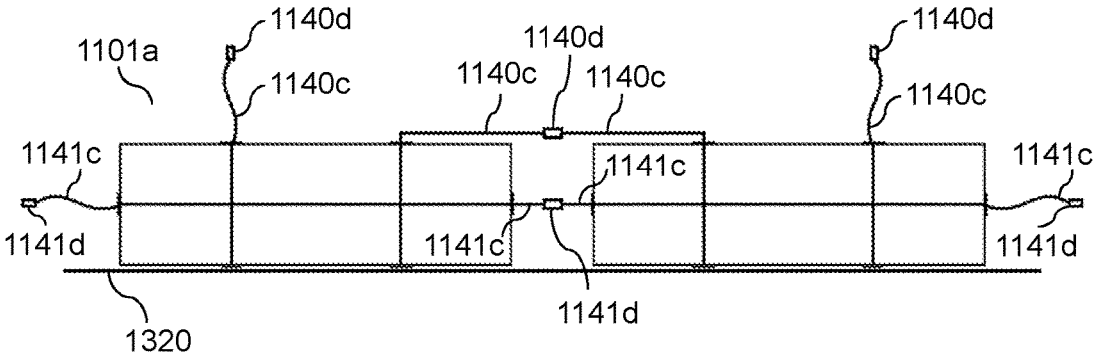
FIG. 13 shows a side cross-section view of two of the cell assemblies of FIG. 11 positioned adjacent each other and joined by their brace assemblies.

FIG. 13 shows a side cross-section view of two of the cell assemblies 1101 of FIG. 11 (labelled 1101*a-b* in FIG. 13) positioned adjacent each other on the ground 1320. The cell assemblies 1101 are joined together by connecting the free ends of the cables 1140*c* of the vertical brace assemblies 1140 using cable-end connectors 1140*d*. The cell assemblies 1101 are also joined together by connecting the free ends of the cables 1141*c* of the horizontal brace assemblies 1141 using cable-end connector 1141*d*. Any suitable cable connecting device could be used. The free ends of the cables of the other vertical brace assemblies of the two cell assemblies 1101*a* and 1101*b*, and the free ends of the horizontal brace assembles, are shown ready for connection to further cell assemblies. While the cell assemblies 1101*a-b* are shown connected using both the free ends of the cables of both the horizontal and vertical brace assemblies, it will be appreciated that neighbouring assemblies could be connected instead by joining together only horizontal brace assemblies, only vertical brace assemblies, and/or by joining horizontal and vertical brace assemblies.

Figure 14:
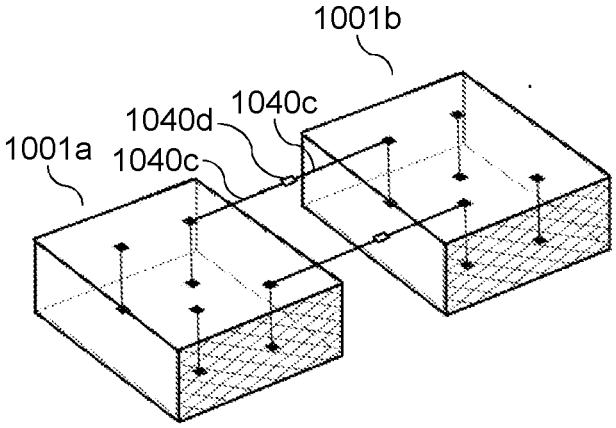
FIG. 14 shows a top perspective view of two of the cell assemblies of FIG. 10 positioned adjacent each other and joined by their brace assemblies.

FIG. 14 shows a top perspective view of two of the cell assemblies 1001 of FIG. 10 (labelled 1001*a-b* in FIG. 14). The cell assemblies 1001 are joined together by connecting the free ends of the cables 1040*c* of the brace assemblies 1040 using cable-end connectors 1040*d*. Any suitable cable connecting device could be used. The free ends of the cables of brace assemblies not used for connection are omitted for clarity.

Figure 15:
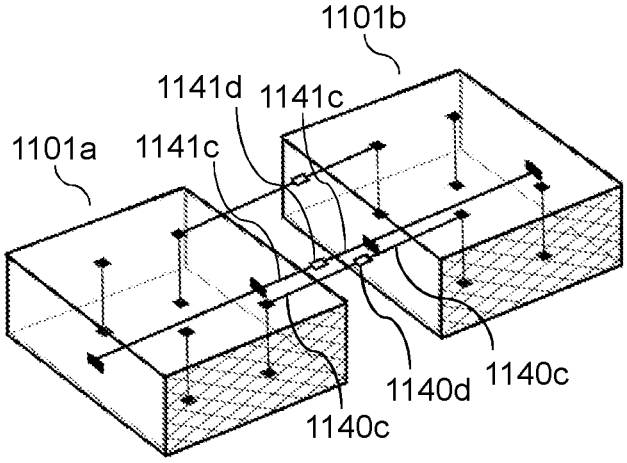
FIG. 15 shows a top perspective view of two of the cell assemblies of FIG. 11 positioned adjacent each other and joined by their brace assemblies

FIG. 15 shows a top perspective view of two of the cell assemblies 1101 of FIG. 11 (labelled 1101*a-b* in FIG. 15). The cell assemblies 1101 are joined together by connecting the free ends of the cables 1140*c* of the vertical brace assemblies 1140 using cable-end connectors 1140*d*, and by connecting adjacent free ends of the cables 1141*c* of the horizontal brace assembles 1141 using cable-end connector 1141*d*. Any suitable cable connecting device could be used. The free ends of the cables of brace assemblies not used for connection are omitted for clarity.

It will be appreciated that cell assemblies may be secured together in other ways, for example by securing assemblies to a sheet of wire mesh spanning two or more assemblies and/or looping a tie wire around one or more cell assemblies.

Figure 16A:
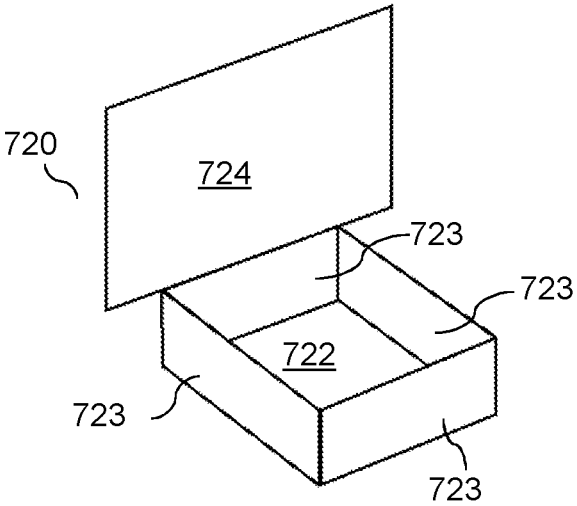
FIGS. 16*a* and 16*b* show a fines barrier bag for a cell assembly in open and closed configurations.
Figure 16B:
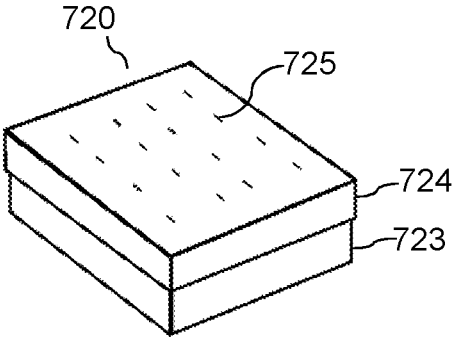

FIG. 16*a* shows the fines barrier bag 720 of FIG. 7 before insertion into a cell, and with its top flap open. The bag 720 comprises a bottom 722, four upstanding sides 723 and a top flap 724. The top flap 724 is larger than the top opening of the bag to allow the flap 724 to be folded down the sides 723 of the bag when closed. The bag 720 is sized to fit snugly into a cell portion. Pressure of the panels of the cell keep the bag closed without the need for fastenings on the bag itself. Suitable bags are entirely made from a biodegradable material, such as sheep wool. FIG. 16*b* shows the bag 720 of FIG. 16*a* with the top flap 724 closed and folded down over the sides 723. As shown in FIG. 16*b*, the top flap 724 may be provided with a plurality of slits 725, through which live plants and/or plant seed can be inserted when the bag is filled and closed inside a cell. Optionally, the inside of the bag may be subdivided by a layer of geotextile material (not shown in FIG. 16*a*), for example to separate a first lower layer of large/coarse fill material from a second upper layer of finer fill material. For example, the first fill material may be rock pieces having a maximum diameter of 75 mm, and optionally a minimum diameter of 50 mm, and the second fill material may be rock pieces having a maximum diameter of 40 mm. Depending on the intended use of the cell assembly, the lid of the bag may be omitted.

Figure 17A:
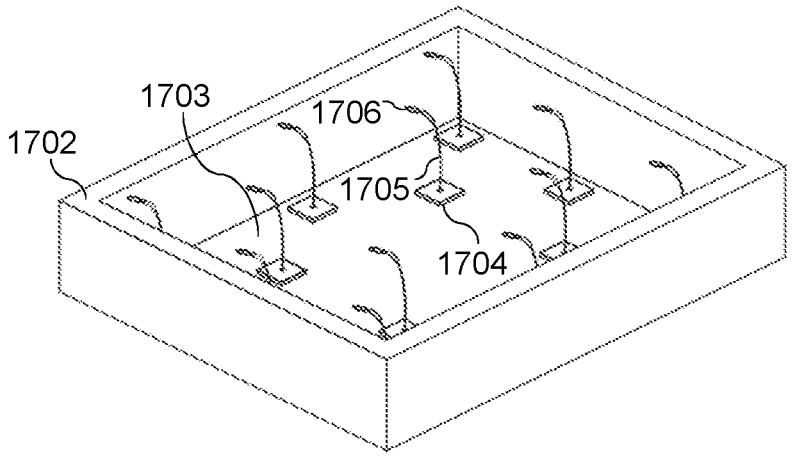
FIGS. 17*a-g* show various perspective views of a cell assembly being constructed and lifted.
Figure 17B:
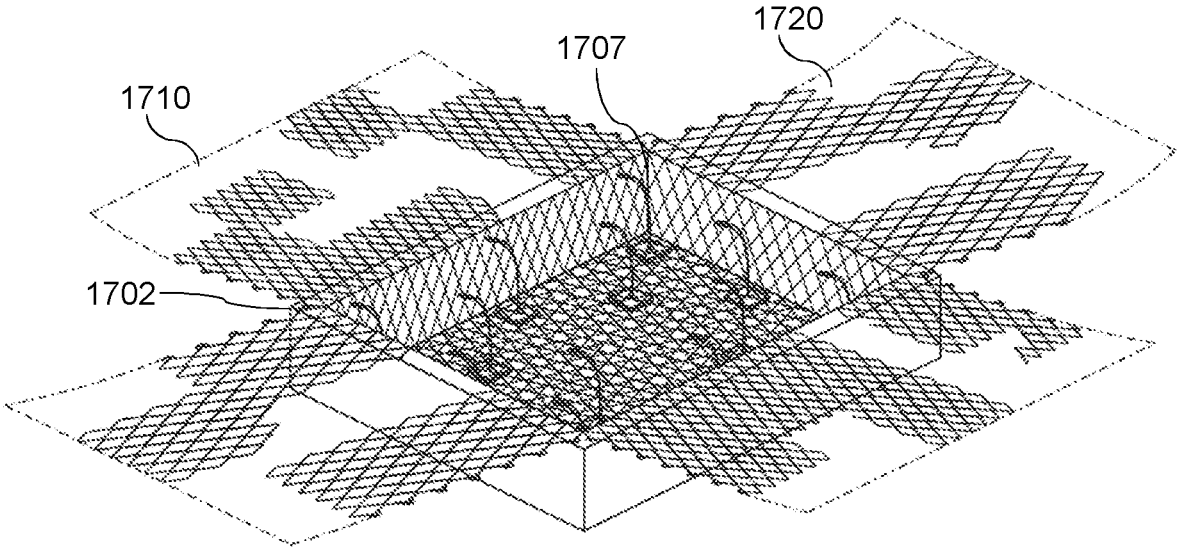
Figure 17C:
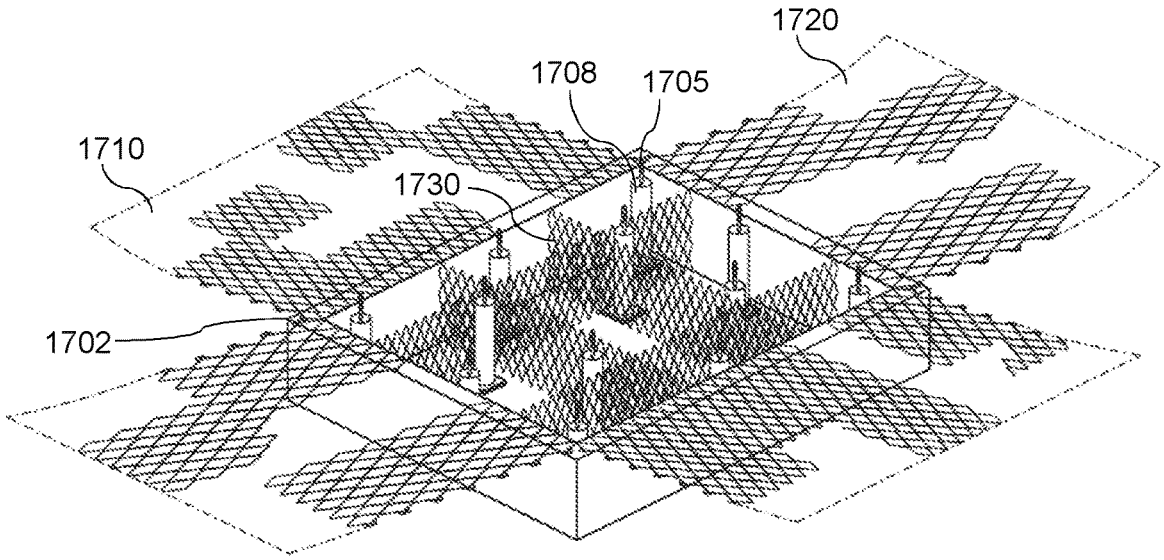
Figure 17D:
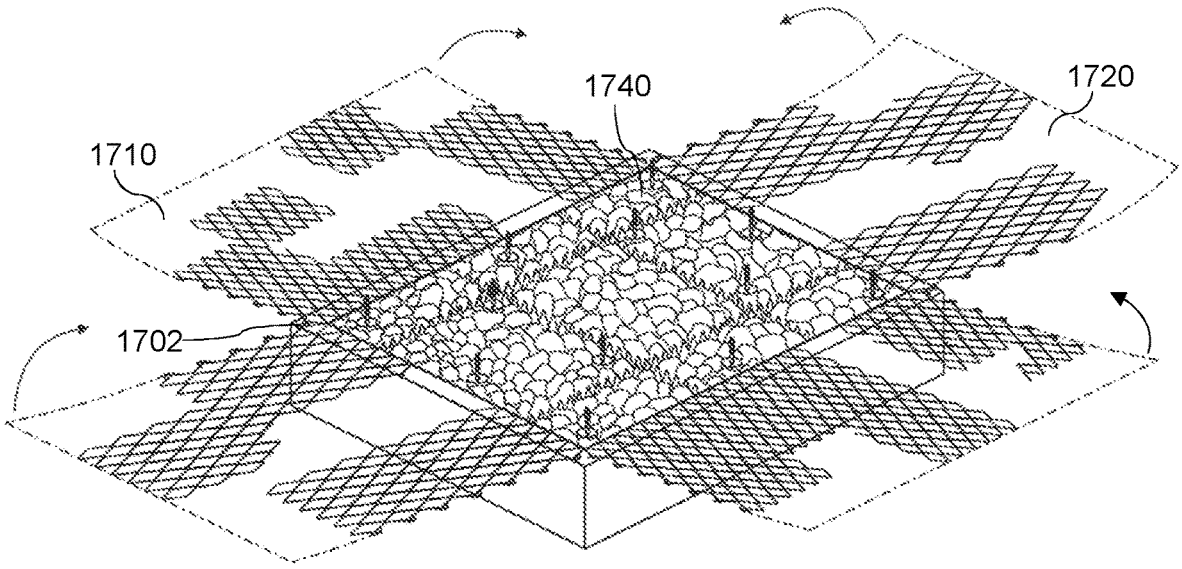
Figure 17E:
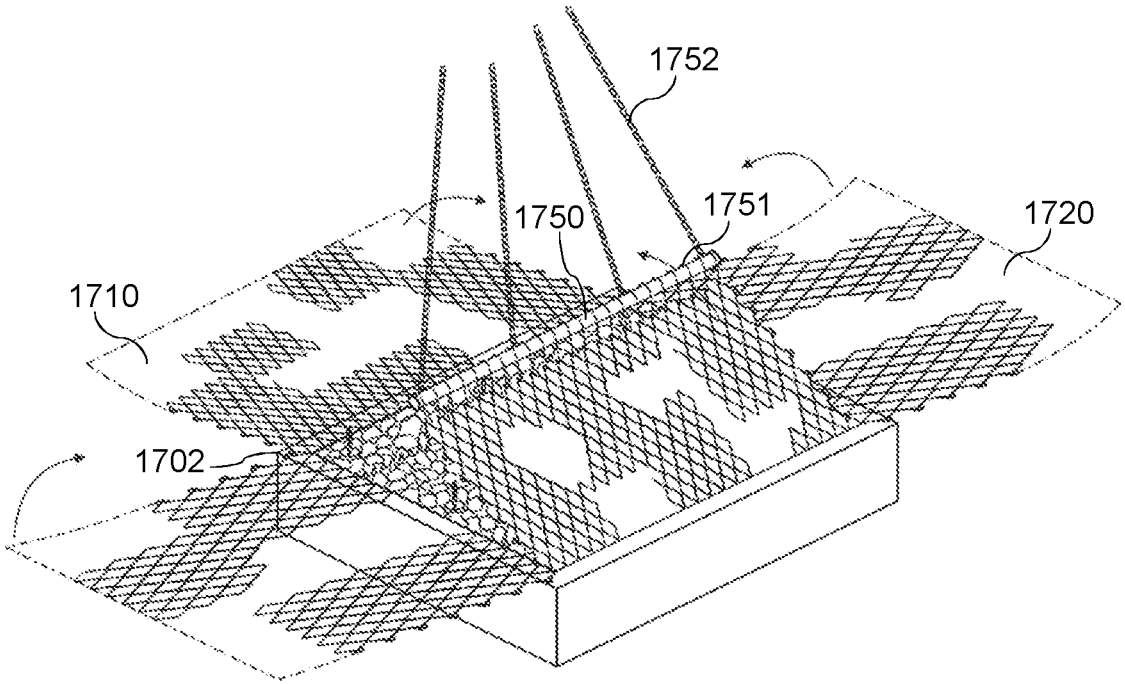
Figure 17F:
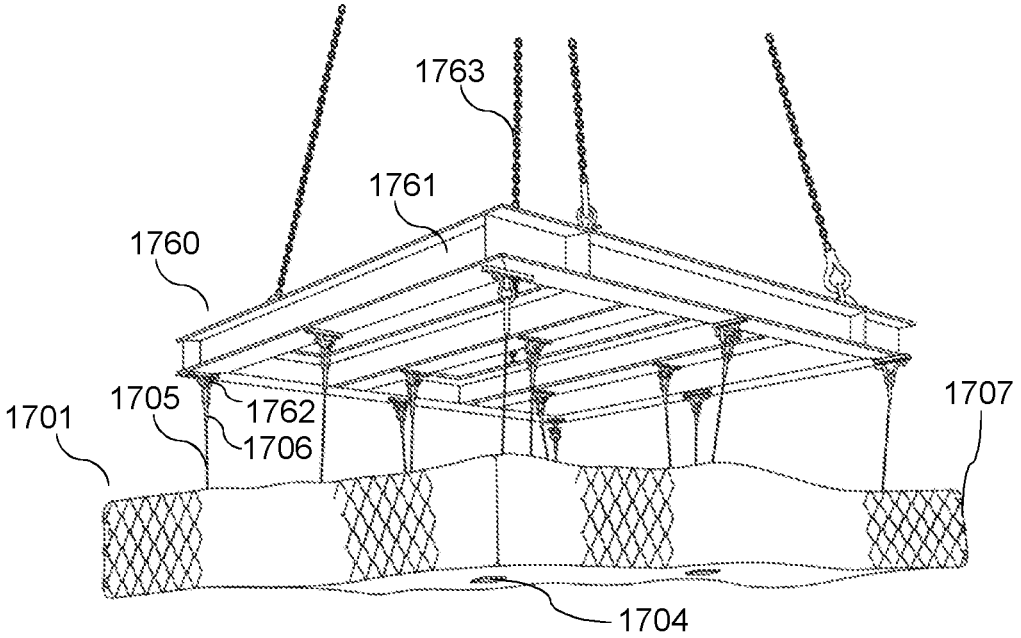
Figure 17G:
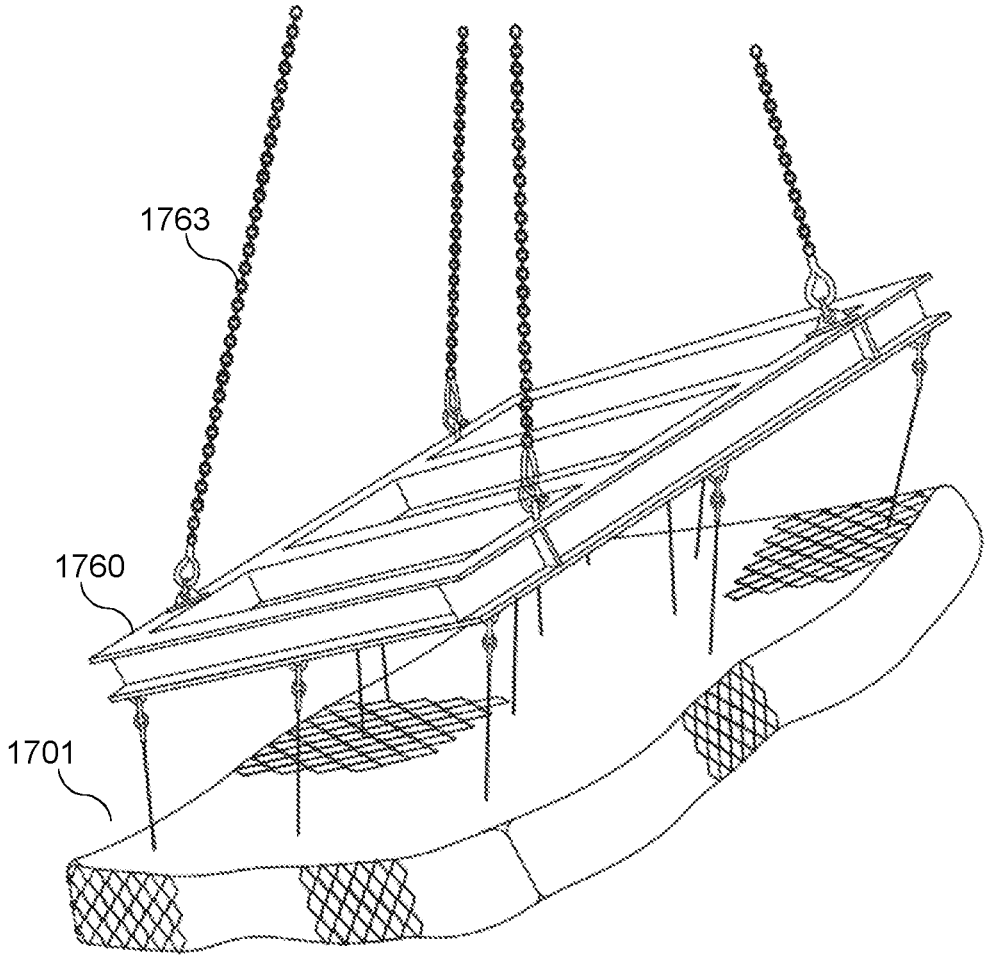

FIGS. 17*a-g* show various perspective views of a cell assembly 1701 according to the invention being constructed and lifted into place, the figures collectively showing a sequence of steps for constructing and installing the cell assembly. FIG. 17*a* shows an open-topped rectangular forming frame 1702 placed on the ground 1703, within which the lower brace plates 1704 and tensioning cables 1705 of twelve brace assemblies are distributed. The forming frame defines an internal cavity 3.5 m×2 m×0.5 m (width×length×height), and is formed from four steel beams welded at the corners. Each brace plate 1704 is a stainless steel plate 8 mm×250 mm×250 mm, with a tensioning cable 1705 attached to its centre. Each tensioning cable 1705 terminates in a connection loop 1706 for attachment to a lifting device. FIG. 17*b* shows the frame 1702 and the partially formed brace assemblies overlaid with first 1710 and second 1720 continuous sheets of chain-link wire mesh. Each wire mesh sheet is Geobrugg® TECCO® high-tensile steel wire mesh G65/3 stainless. In the figures, the mesh diamonds are omitted on parts of the sheets for clarity (the overall outline of each sheet is shown in dot-dash lines where the mesh pattern is omitted. Other wire meshes could be used, including Al/Zn coated steel wire mesh, such as other Geobrugg® TECCO® mesh products. The first sheet 1710 has a width of 3.5 m and a length of 6 m; the second sheet 1720 has a width of 2 m and a length of 9 m. Each sheet is formed from a plurality of parallel, zig-zag shaped interlaced stainless steel wires that extend from one side to the opposite side in a general direction parallel to the ends of the sheet, thereby allowing the sheet to be wrapped around the faces of the cell assembly without bending the individual wires. In FIG. 17*b* the free ends of each sheet 1710, 1720 are folded out over the sides of the frame 1702. The brace plates 1704 of the bracing assemblies lie underneath the sheets 1710, 1720, with the tensioning cables 1705 protruding up through mesh openings. The sheets 1710, 1720 are laid across each over so that they overlap on the lower face of the cell assembly (on the ground 1703 inside the frame 1702), and are fastened together on the vertical edges 1707 of the cell assembly (inside the frame 1702) by stainless steel helicoil fastenings (not shown in FIG. 17*b*). FIG. 17*c* shows wire mesh panels 1730 (made from the same mesh material as the sheets 1710, 1720) inserted into the cell assembly forming baffles subdividing the internal volume of the cell assembly into twelve cells. In the figures, the cells are shown having different sizes; alternatively each cell may be approximately the same size. In FIG. 17*c*, the diamond pattern of the mesh of the sheets 1710, 1720 on the inside of the frame 1702 is omitted for clarity. The panels 1730 are fastened to each other and to the sheets 1710, 1720 where they intersect using stainless steel helicoil fastenings. Also shown in FIG. 17*c* are support tubes 1708 placed over the tensioning cables 1705 of the brace assemblies (provided to keep the cables upright when the cells are filled). FIG. 17*d* shows fill material 1740 (comprising rock pieces sized larger than the mesh openings) inserted into the cells. Fill material may be added and compacted by any convenient equipment, such as an excavator (not shown in FIG. 17*d*). FIG. 17*d* also includes arrows indicating that the free ends of sheets 1710, 1720 can now be folded across the top of the cells to close the cell assembly. It will be appreciated that support tubes 1708 may be left in place, or removed, once fill material is added to the cells. FIG. 17*e* shows one free end of sheet 1710 being drawn across the top of the cell. The end wire of the sheet is attached to a drawbar 1750 by a series of hooks 1751, the drawbar being connected to lifting equipment (such as an excavator or crane, not shown in FIG. 17*d*) by four chains 1752. In FIG. 17*e*, the end of the sheet 1710 being drawn across the top of the cell assembly is shown as an apparently solid sheet (so that features underlying the sheet cannot be seen through the openings of the wire mesh) for clarity. Each free end is drawn across in turn, first with the free ends of first sheet 1710 stretched across and joined by a first overlapping join (the length of overlap being about 1 m), and then the free ends of second sheet 1720 stretched across an joined by a second overlapping join (the length of overlap being about 1 m. The sheets are joined together using stainless steel helicoil fastenings (not shown in FIG. 17*e*). It will be appreciated that a shorter overlap could be used, reducing the amount of wire mesh required. The drawbar 1750 is used to stretch the sheets across the top of the cells, applying a tension of 15 kN to each sheet end. After fastening the sheet ends together, the tension along the length of each sheet was about 2.5 kN. Optionally, the first (lower) end of each sheet 1710, 1720 may be tensioned and fastened to one or more of the baffle panels 1730 to hold it in place while the second (upper) end of each sheet is stretched across and fastened to the first end by an overlapping join. Alternatively, the first end of each sheet 1710, 1720 may be drawn across and laid on the top of the cell assembly without fastening, before the second ends of the sheets are stretched across and fastened. Once all four free ends of the sheets 1710, 1720 are folded across and secured, and the brace assemblies completed by securing the upper brace plates (each being a stainless steel plate 8 mm×250 mm×250 mm with a centre through-hole for receiving a tensioning cable 1705 and held in place by a one-way clip on the cable; not shown in FIG. 17*e*) the cell assembly is complete and ready to be separated from the frame 1702. It will be appreciated that larger brace plates may be desirable, depending on the size of the cell assembly and the spacing of the bracing assemblies. The cell assembly 1701 has at least a double layer of wire mesh across all of its top (since the first and second sheets 1710, 1720 are each joined end to end), but only a relatively small area has a quadruple layer of wore mesh (i.e. where the two overlapping joins between sheet ends overlap each other). Most of the twelve bracing assemblies are positioned in a double layer area. FIG. 17*f* shows the completed cell assembly 1701 suspended from a lifting frame 1760. The lifting frame 1760 is made up of six rolled steel joists 1761 welded together and provided with twelve attachment points in the form of brackets 1762. The tensioning cables 1705 of the brace assemblies are attached to the brackets 1762 using end loops 1706, so that the cell assembly 1701 is suspended from the lifting frame 1760 by the brace assemblies. The lifting frame 1760 is attached to lifting equipment (a crane, not shown in FIG. 17*f*) by chains 1763. As shown in FIG. 17*f*, the wire mesh of the cell assembly 1701 is pulled tight around the fill material, distorting the shape of the assembly. It will be appreciated that lift assemblies could be used in place of brace assemblies. FIG. 17*g* shows the cell assembly 1701 being lifted at an angle so that the cell assembly 1701 can be place on a slope. The cell assembly is tilted to an angle by adjusting the angle of the lifting frame 1760, which in turn is angled by changing the lengths of the chains 1763 connecting the frame 1760 to the lift equipment. It has been found than an ability to tilt the cell assembly in a controlled manner is a particularly useful advantage facilitated by the lift arrangement of the cell assembly of the invention. In FIG. 17*g*, the cell assembly 1701 is shown fitted with lift assemblies rather than brace assemblies (i.e. upper brace plates have not been used). FIGS. 17*f-g* show that when mesh is tensioned around fill material, each face of the cell assembly may distort, especially when rocks are used as the fill material. In particular, all corners and/or edges of the cell assembly may be rounded, and/or faces may be curved and/or undulating. Nevertheless, the cell assembly retains its overall shape, having opposed upper and lower faces, opposed end faces and opposed side faces. It will be appreciated that the order of steps illustrated in FIGS. 17*a-g* is optional—one or more of the steps illustrated may be performed in a different order. For example, bracing assemblies could be moved into position after the sheets are arranged in the forming frame. In FIGS. 17*a*-17*g*, each continuous length 1720, 1720 is made from a single continuous sheet of mesh. It will be appreciated that a larger assembly could be formed (e.g. having a width of more than 3.5 m, such as 5 m or more) by joining two single continuous sheets side by side, preferably by an overlapping join. It will be appreciated that two sheets joined side to side would provide a wider continuous length, allowing formation of a wider cell assembly. It will be appreciated that when two sheets of china-link mesh having knotted ends are joined side to side by an overlapping join, the knotted ends of one sheet lie over or under the mesh of the adjacent sheet.

It will be appreciated that any cell design depicted in the figures may optionally include additional features described herein, such as one or more horizontal brace assemblies for tying together opposing side/end faces, and/or a stiffening mesh, e.g. in the form of a welded reinforcement mesh panel such as A393 mesh.

Coastal erosion prevention systems are often exposed to extreme forces, causing movement of even the largest of rocks commonly used for rock armour. In conventional sea defences, such forces tend to be damaging, weakening the system over time. However, a result of the fully integrated structure of the system of the present invention is that distortions of the system increases tension in the wire mesh, strengthening the structure. This is especially true when the mesh is formed from high tensile, (stainless) steel wire.

While the present invention has been described and illustrated with reference to particular embodiments, it will be appreciated by those of ordinary skill in the art that the invention lends itself to many different variations not specifically illustrated herein. Where in the foregoing description, integers or elements are mentioned which have known, obvious or foreseeable equivalents, then such equivalents are herein incorporated as if individually set forth. Reference should be made to the claims for determining the true scope of the present invention, which should be construed so as to encompass any such equivalents. It will also be appreciated by the reader that integers or features of the invention that are described as preferable, advantageous, convenient or the like are optional and do not limit the scope of the independent claims. Moreover, it is to be understood that such optional integers or features, whilst of possible benefit in some embodiments of the invention, may not be desirable, and may therefore be absent, in other embodiments.

The invention claimed is:

1. A cell assembly for a ground protection system, the cell assembly comprising opposed upper and lower faces, opposed first and second end faces and opposed first and second side faces, wherein the cell assembly comprises at least one cell for containment of rock pieces;

wherein a first continuous length of chain-link wire mesh wraps around to define the opposed upper and lower faces and the opposed first and second end faces of the cell assembly, the first continuous length of wire mesh comprising a single continuous sheet of chain-link wire mesh having a first end and a second end overlapped and fastened together to form an overlapping join positioned on the upper, first end and/or second end face of the cell assembly, wherein the single continuous sheet wraps around to span each of the upper, lower and first and second end faces of the cell assembly, wherein the first side face of the cell assembly is defined by a second continuous length of chain-link wire mesh that at least partially wraps around a face of the cell assembly adjacent the first side face, the second continuous length comprising a single continuous sheet of chain-link wire mesh that spans the first side face and extends across at least a portion of said adjacent face;

and wherein:

the second side face of the cell assembly is also defined by the second continuous length of chain-link wire mesh, wherein the single continuous sheet of the second continuous length spans the second side face and spans said adjacent face of the cell assembly; and the single continuous sheet of the second continuous length extends across at least a portion of the upper face of the cell assembly;

or the second side face of the cell assembly is defined by a third continuous length of chain-link wire mesh that at least partially wraps around a face of the cell assembly adjacent the second side face, the third continuous length comprising a single continuous sheet of chain-link wire mesh that spans the second side face and extends across at least a portion of said adjacent face;

the single continuous sheet of the second continuous length extends across at least a portion of the upper face of the cell assembly; and the single continuous sheet of the third continuous length extends across at least a portion of the upper face of the cell assembly.

2. The cell assembly of claim 1, wherein the first continuous length of chain-link wire mesh consists of said single continuous sheet of chain-link wire mesh.

3. The cell assembly of claim 1, wherein the second continuous length of chain-link wire mesh defines both the first and second side faces and extends across the lower face of the cell assembly, thereby overlapping the first continuous length of wire mesh on the lower face of the cell assembly, wherein the single continuous sheet of the second continuous length spans the first and second side faces and the lower face of the cell assembly and extends across at least a portion of the upper face of the cell assembly.

4. The cell assembly according to claim 3, wherein the single continuous sheet of the second continuous length has a first end and a second end, said first and second ends being overlapped and fastened together to form another overlapping join positioned on the upper, first side and/or second side face of the cell assembly, optionally the overlapping join is positioned on the upper face of the cell assembly.

5. The cell assembly of claim 3, wherein the second continuous length consists of said single continuous sheet of chain-link wire mesh, and wherein the third continuous length, if present, consists of said single continuous sheet of chain-link wire mesh.

6. The cell assembly of claim 1, wherein the second side face is defined by the third continuous length of chain-link wire mesh, wherein the single continuous sheet of the second continuous length and the single continuous sheet of the third continuous length each extend across at least a portion of the upper face of the cell assembly.

7. The cell assembly according to claim 1, wherein the cell assembly comprises a plurality of cells, wherein one or more chain-link wire mesh baffles separate the cells to subdivide the cell assembly.

8. The cell assembly according to claim 1, comprising a strengthening grid positioned inside the at least one cell, the strengthening grid being a welded wire mesh formed from stainless steel rods each having a diameter of at least 8 mm, wherein the strengthening grid extends across at least 75% of a first internal width and across at least 75% of a second internal width of the cell, wherein the first internal width is the distance between opposed ends, and the second internal width is the distance between opposed sides, of the cell.

9. The cell assembly according to claim 1, wherein the wire meshes are formed from high tensile stainless steel wire having a diameter of at least 2 mm and a tensile strength of at least 1,000 $N/mm^2$;

optionally wherein the sheets of wire mesh are fastened together with tie wires and/or a plurality of clips, wherein the tie wires and/or the plurality of clips are formed from high tensile stainless steel wire having a diameter of at least 2 mm and a tensile strength of at least 1,000 $N/mm^2$.

10. The cell assembly according to claim 1, wherein the sheets of chain-link wire mesh comprise two opposed side edges and two opposed end edges forming the continuous lengths of chain-link wire mesh and each sheet is formed from interlaced wires extending from one side edge to the opposed side edge in a direction parallel to the opposed end edges, and wherein wire ends are knotted into loops that interlock with a corresponding loop on the end of an adjacent wire.

11. The cell assembly according to claim 1, wherein the cell assembly comprises a plurality of lift assemblies, each lift assembly comprising a lift plate positioned below the lower face of the cell assembly, and a lift cable secured to the lift plate and extending upwards through the cell assembly and outwards from the upper face, wherein each lift cable is configured for attachment to a lifting device, optionally wherein the lifting device is a lifting frame.

12. The cell assembly according to claim 1, wherein the cell assembly comprises:

a plurality of vertical brace assemblies tying the wire mesh extending across the lower face of the cell assembly to the wire mesh extending across the upper face of the cell assembly, wherein each vertical brace assembly comprises a lower brace plate disposed below the wire mesh of the lower face of the cell assembly, an upper brace plate disposed above the wire mesh of the upper face, and a tensioning member joining the lower brace plate to the upper brace plate, and/or at least one horizontal brace assembly tying the wire mesh extending across the side or end face of the cell assembly to the wire mesh extending across the opposing side or end face of the cell assembly, wherein each horizontal brace assembly comprises a first brace plate disposed outside the wire mesh of the side or end face of the cell assembly, a second brace plate disposed outside the wire mesh of the opposed side or end face, and a tensioning member joining the first brace plate to the second brace plate.

13. A ground protection system comprising a plurality of cell assemblies according to claim 1, wherein the cell assemblies are secured together;

optionally wherein each cell assembly has a brace assembly fastened to a brace assembly on another cell assembly, optionally wherein the cell assemblies each comprise:

a plurality of vertical brace assemblies tying the wire mesh extending across the lower face of the cell assembly to the wire mesh extending across the upper face of the cell assembly, wherein each vertical brace assembly comprises a lower brace plate disposed below the wire mesh of the lower face of the cell assembly, an upper brace plate disposed above the wire mesh of the upper face, and a tensioning member joining the lower brace plate to the upper brace plate, and/or at least one horizontal brace assembly tying the wire mesh extending across the side or end face of the cell assembly to the wire mesh extending across the opposing side or end face of the cell assembly, wherein each horizontal brace assembly comprises a first brace plate disposed outside the wire mesh of the side or end face of the cell assembly, a second brace plate disposed outside the wire mesh of the opposed side or end face, and a tensioning member joining the first brace plate to the second brace plate; and wherein the tensioning member of the vertical or horizontal bracing assembly of each cell assembly is connected to a corresponding tensioning member of a vertical or horizontal bracing assembly of an adjacent cell assembly.

14. A kit of parts for forming the cell assembly of claim 1, the kit of parts comprising:

at least one chain-link wire mesh sheet for forming the first continuous length of chain-link wire mesh for defining the lower, first and second end and upper faces of the cell assembly, at least one additional chain-link wire mesh sheet for forming the second continuous length of chain-link wire mesh, and the third continuous length if present, for defining the first and second side faces of the cell assembly, each additional continuous chain-link wire mesh sheet being arranged for defining a side face and at least partially wrapping around another adjacent face of the cell assembly, and, fastenings for forming overlapping joins between sheets, and a forming frame for supporting the sides and ends of the cell assembly during construction and filing with fill material, the forming frame being an open-topped frame sized to extend around the first and second sides and the first and second ends of the cell assembly.

15. The kit of parts according to claim 14, comprising a plurality of vertical and/or horizontal brace assemblies for tying wire mesh extending across the lower face to wire mesh extending across the upper face of the cell assembly and/or wire mesh extending across the first side/end face to wire mesh extending across the second side/end face, wherein each brace assembly comprises a lower/first brace plate, an upper/second brace plate, and a tensioning member for joining the lower/first brace plate to the upper/second brace plate, and optionally a retainer for holding the upper/second brace plate in position on the tensioning member;

optionally wherein a plurality of the brace assemblies is configured for suspending the cell assembly from a lifting device, once the cell assembly is constructed and the cell(s) filled with fill material, optionally wherein each tensioning member of said brace assemblies is configured for attachment to a lifting device, optionally wherein the lifting device is a lifting frame.

16. The kit of parts according to claim 14, comprising a plurality of lift assemblies for suspending the cell assembly from a lifting device, optionally wherein the lifting device is a lift frame, once the cell assembly is constructed and the cell(s) filled with fill material, wherein each lift assembly comprises a lift plate and a lift cable securable to the lift plate and connectable to said lifting device.

17. The kit of parts according to claim 14, wherein the cell assembly comprises a plurality of cells, wherein the kit comprises at least one chain-link wire mesh panel for forming a baffle for subdividing the cell assembly into the plurality of cells.

18. A method of constructing a cell assembly according to claim 1, the method comprising:

fastening the first continuous length of chain-link wire mesh for defining the lower, first and second end and upper faces of the cell assembly to the second continuous length of chain-link wire mesh, and the third continuous length if present, for defining the first and second side faces of the cell assembly, wherein the at least one cell has an open top, inserting fill material into the at least one cell, and securing the first continuous length of chain-link wire mesh across the upper face of the cell assembly by fastening together the ends of each continuous sheet of chain-link wire mesh forming the first continuous length, and fastening the first continuous length of chain-link wire mesh to the second continuous length of chain-link wire mesh, and the third continuous length if present, for defining the first and second side faces, thereby closing the at least one cell so that the first continuous length of chain-link wire mesh defining the first and second end and upper faces of the cell assembly overlaps and/or is overlapped by the second continuous length of chain-link wire mesh, and the third continuous length if present, defining the first and second side faces of the cell assembly;

optionally wherein the method comprises using a forming frame to control the shape of the cell assembly during the step of inserting fill material into the at least one cell the at least one cell, optionally wherein the fill material is compacted before the step of closing the at least one cell.

19. The method according to claim 18, comprising installing at least part of one or more brace assemblies in the cell before the step of inserting fill material into the at least one cell, and completing the brace assemblies after the step of closing the cells to tie the wire mesh extending across the lower face of the cell assembly to wire mesh extending across the upper face of the cell assembly; and/or comprising installing a plurality of lift assemblies in the cell assembly before the step of inserting fill material into the at least one cell.

20. A method of constructing a ground protection system, the method comprising lifting a plurality of cell assemblies according to claim 1 into an installation position by suspending each cell assembly from a lifting device, optionally wherein the lifting device is a lifting frame, and securing the cell assemblies together, optionally by connecting at least one brace assembly of each cell assembly to a brace assembly of another cell assembly, optionally by connecting together tensioning members of said brace assemblies.

* * * * *